US007328798B2

(12) United States Patent
Auclair et al.

(10) Patent No.: US 7,328,798 B2
(45) Date of Patent: Feb. 12, 2008

(54) CARTON WITH TWO-STEP OPENING FEATURE DEFINING YIELDABLE DISPENSER

(75) Inventors: Jean-Michel Auclair, Chateaurox (FR); Patrick Blin, Chateauroux (FR); Aaron Bates, Powder Springs, GA (US); Erica Watson, Smyrna, GA (US); John W. Cargile, Jr., Decatur, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 354 days.

(21) Appl. No.: 11/047,280

(22) Filed: Jan. 31, 2005

(65) Prior Publication Data

US 2005/0126947 A1 Jun. 16, 2005

Related U.S. Application Data

(63) Continuation-in-part of application No. 10/717,254, filed on Nov. 19, 2003, now Pat. No. 7,073,665.

(60) Provisional application No. 60/617,533, filed on Oct. 8, 2004, provisional application No. 60/615,928, filed on Oct. 4, 2004, provisional application No. 60/615,927, filed on Oct. 4, 2004, provisional application No. 60/615,379, filed on Sep. 30, 2004.

(51) Int. Cl.

| | |
|---|---|
| ***B65D 75/00*** | (2006.01) |
| ***B65D 5/72*** | (2006.01) |
| ***B65D 17/28*** | (2006.01) |
| ***A47F 1/04*** | (2006.01) |

(52) U.S. Cl. ..... 206/427; 221/305; 221/309; 229/122; 229/240

(58) Field of Classification Search ..... 206/427, 206/735–736, 745; 229/103–104, 120.011, 229/122–122.1, 123, 235, 240–242
See application file for complete search history.

(56) References Cited

U.S. PATENT DOCUMENTS

| | | | | |
|---|---|---|---|---|
| 3,127,991 | A * | 4/1964 | Burnett | 229/242 |
| 3,178,242 | A | 4/1965 | Ellis et al. | |
| 3,228,582 | A * | 1/1966 | Osberg | 229/242 |
| 3,237,837 | A | 3/1966 | Vizethann | |
| 3,263,861 | A | 8/1966 | Carr | |

(Continued)

FOREIGN PATENT DOCUMENTS

| | | |
|---|---|---|
| EP | 0 203 806 | 12/1986 |

(Continued)

*Primary Examiner*—Bryon P. Gehman

(57) ABSTRACT

A carton for dispensing and retaining articles such as cans or bottles is opened by at least partially removing a first detachable portion and then by at least partially detaching a second detachable portion. Removal of the first detachable portion defines an opening for dispensing articles, and defines means for retaining articles in the carton after one or both of the detachable portions have been removed, such as a stopper wall. Removal of the first detachable portion provides access to the second detachable portion to facilitate subsequent and at least partial detachment thereof. The second detachable portion may be yieldable so as to variably and reversibly redefine or reconfigure the opening to enlarge the opening to facilitate removal of articles that are being dispensed, and to reduce the opening to retain articles in the carton that are not being dispensed.

25 Claims, 16 Drawing Sheets

U.S. PATENT DOCUMENTS

| | | | | |
|---|---|---|---|---|
| 3,265,283 | A | 8/1966 | Farquhar | |
| 3,315,875 | A * | 4/1967 | Praetorius | 229/242 |
| 3,356,279 | A | 12/1967 | Root | |
| 3,416,719 | A | 12/1968 | Pilger | |
| 3,653,495 | A | 4/1972 | Gray | |
| 4,340,170 | A | 7/1982 | Montealegre | |
| D270,041 | S | 8/1983 | Vestal | |
| 4,396,143 | A | 8/1983 | Killy | |
| 4,417,661 | A | 11/1983 | Roccaforte | |
| 4,946,042 | A * | 8/1990 | Ferreri et al. | 229/242 |
| 5,505,372 | A | 4/1996 | Edson et al. | |
| 5,622,309 | A | 4/1997 | Matsuda et al. | |
| 5,927,498 | A | 7/1999 | Saam | |
| 6,283,293 | B1 | 9/2001 | Lingamfelter | |
| 6,484,903 | B2 | 11/2002 | Spivey et al. | |
| 6,550,615 | B2 | 4/2003 | Lingamfelter | |
| 6,578,736 | B2 | 6/2003 | Spivey | |
| 6,715,639 | B2 | 4/2004 | Spivey | |
| 6,789,673 | B2 | 9/2004 | Lingamfelter | |
| 6,866,188 | B2 | 3/2005 | Harrelson | |
| 6,902,104 | B2 * | 6/2005 | Holley et al. | 229/242 |
| 6,959,857 | B2 * | 11/2005 | Bates | 229/122.1 |
| 7,073,665 | B2 * | 7/2006 | Auclair et al. | 206/427 |
| 2004/0089671 | A1 | 5/2004 | Miller | |
| 2004/0112948 | A1 * | 6/2004 | Bone | 229/122 |
| 2004/0164136 | A1 | 8/2004 | Harrelson | |
| 2004/0188300 | A1 | 9/2004 | Sutherland | |
| 2004/0232214 | A1 | 11/2004 | Bates | |
| 2005/0000853 | A1 * | 1/2005 | Rochefort et al. | 206/736 |

FOREIGN PATENT DOCUMENTS

| | | |
|---|---|---|
| WO | WO 96/29260 | 9/1996 |
| WO | WO 02/47990 | 6/2002 |

* cited by examiner

100

136b
138b
110
118
138a
136a
128b
130b
106
140
146
130a
128a
132b
134b
108
116
H
144
142
T
134a
132a
124b
126b
114
104
112
148
140
126a
124a
120b
122b
102
122a
120a

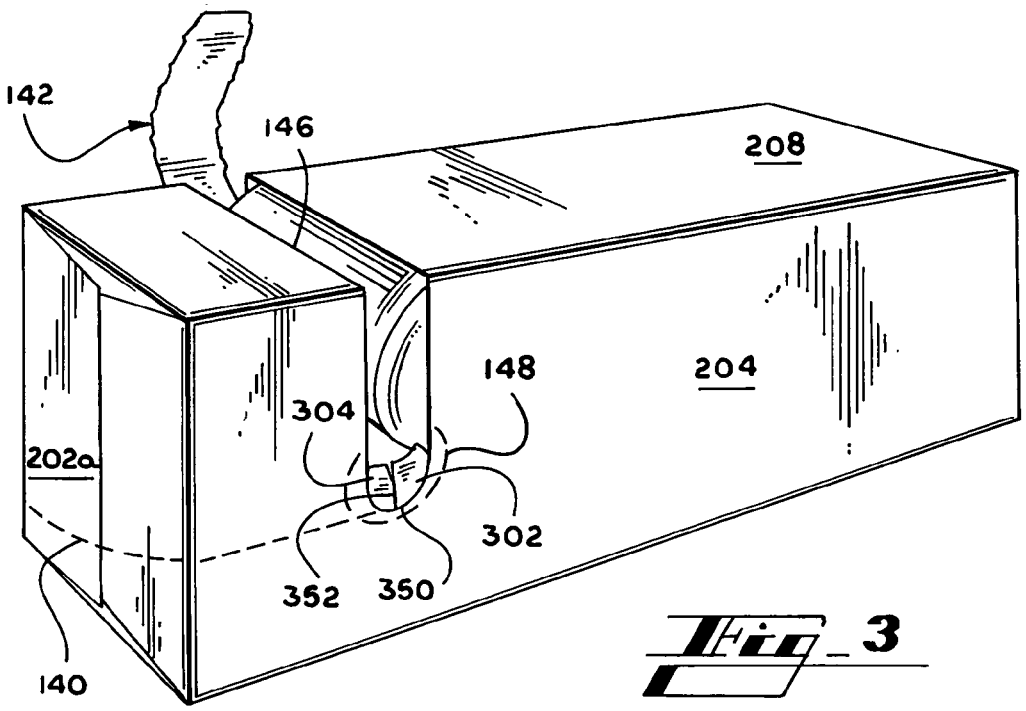
Fig. 3
Fig. 4
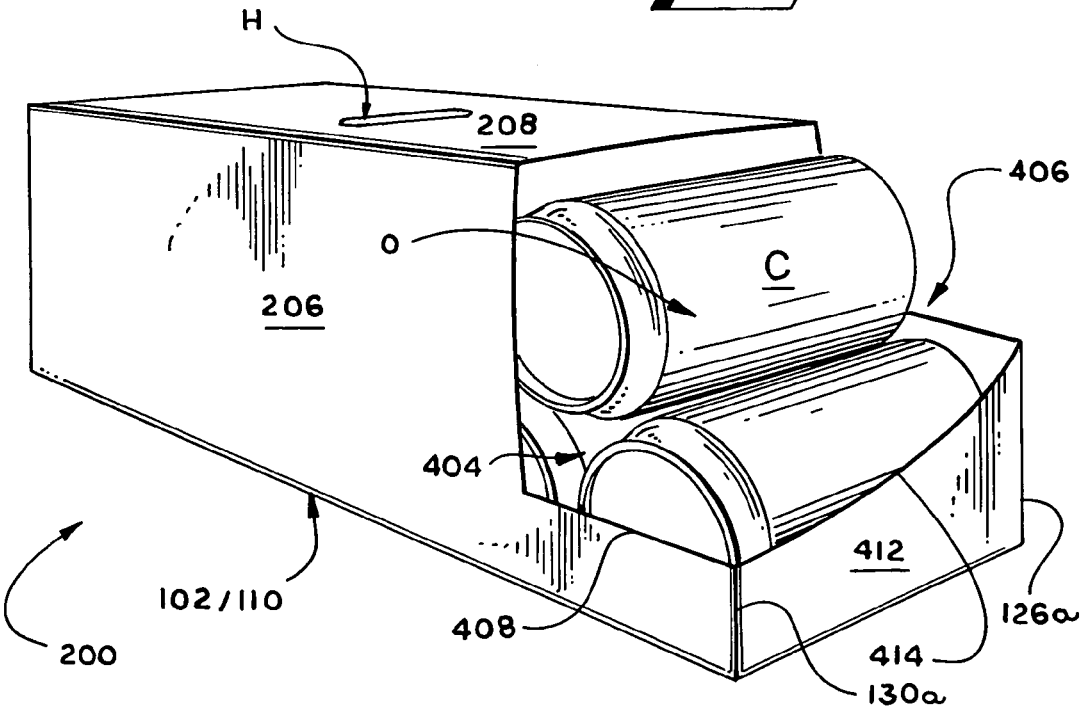

CARTON WITH TWO-STEP OPENING FEATURE DEFINING YIELDABLE DISPENSER

RELATED APPLICATIONS

This application is a continuation-in-part of U.S. patent application Ser. No. 10/717,254 filed on Nov. 19, 2003, now U.S. Pat. No. 7,073,665 the entirety of which is incorporated herein by reference. This application also claims the benefit of the filing dates of U.S. Provisional Patent Application Ser. No. 60/615,379, filed on Sep. 30, 2004; U.S. Provisional Patent Application Ser. No. 60/615,927, filed on Oct. 4, 2004; U.S. Provisional Patent Application Ser. No. 60/615,928, filed on Oct. 4, 2004; and U.S. Provisional Patent Application Ser. No. 60/617,533, filed on Oct. 8, 2004, the entirety of each is incorporated herein by reference.

TECHNICAL FIELD

This invention relates generally to cartons for packaging multiple articles such as beverage cans or bottles, and more particularly, to a paperboard carton with a two-step opening feature for providing an article dispenser with an enlargeable access opening through which one or more articles in the carton may be dispensed at once.

BACKGROUND OF THE INVENTION

Cartons for encasing and dispensing multiple articles such as soft drink cans or bottles are useful for enabling consumers to transport, store, and access the articles for consumption. The consumer typically prefers the flexibility to easily access the articles one at a time. To that end, some cartons have dispensers which allow one or more articles to be removed, while continuing to encase the remaining articles. The consumer tears out a portion of the carton to form an opening from which articles may be dispensed.

Such beverage cartons with article dispensers are known in the art. Typically, the article dispenser is defined by a relatively large detachable section of carton that is torn away from the carton by breaking a perforated line. It can be difficult to separate a single detachable section, as the force required to remove the detachable section can easily cause the detachable section to be undesirably ripped into two or more pieces. The user then must tear away the individual pieces or use the dispenser with the remnants of the detachable section in place.

What is needed, therefore, is a carton that is provided with an improved article dispenser having an opening that is large enough to remove articles one or more at a time, but is more convenient to open. Such a carton should have a user-friendly means for grasping and removing the removable portion, as well as a reliable article stopper.

SUMMARY OF THE INVENTION

The present invention advantageously reduces the effort required to access articles in a carton and improves the retention of articles remaining in the carton. More specifically, the present invention provides a carton with a dispenser having multiple detachable portions that border one another at one end of the carton. The detachable portions may be separately and at least partially detached from the carton to define an opening for dispensing articles and to restrain articles remaining in the carton.

Generally described, a plurality of panels are connected together to form the carton of the present invention. At least three of the panels are adjacent to one another. When the carton is erected, the panels cooperate to form carton walls for encasing a plurality of articles.

According to one aspect of the invention, the carton includes at least one first detachable portion that facilitates at least partial removal of at least one second at least partially detachable portion. The first detachable portion is a substantially integral portion of the carton that is formed from at least a portion of adjacent first and second carton walls. After removal of the first detachable portion, at least one adjacent part of one or both of the first and second walls remains intact. Removal of the first detachable portion exposes at least one edge of the second detachable portion, which then can be used as a more convenient handhold for initiating and effecting at least partial removal of the second detachable portion.

In certain embodiments, the first detachable portion is a tear strip, at least partial removal of which at least partially defines an opening for dispensing articles and/or facilitates access to the second detachable portion. The second detachable portion can be yieldable, thereby allowing selective removal of articles from the carton while preventing articles from undesirably rolling or falling out of the carton, and may be completely detached when it is no longer needed to retain articles in the carton. For example, the second detachable portion can function as a detachable retention means for yieldably restraining articles in an upper row of the carton. Completely detaching the second detachable portion defines at least one edge of an integral retention means, such as an article stopper comprising portions of an end and sides of the carton. In accordance with the previous example, such an article stopper may rigidly restrain articles in a lower row of the carton after articles in the upper row no longer require the support of the second detachable portion to avoid the risk of falling out.

The second detachable portion may be only partially detachable so as to become a yieldable portion that variably and reversibly reconfigures (that is, enlarges and reduces) the opening, and restrains the articles within the carton after the first detachable portion has been removed. The carton may include more than one second detachable portion, each functioning to restrain at least a portion of at least one article.

According to another aspect of the invention, the first detachable portion is defined by a first severance line that is readily or easily broken, such as a frangible line weakened by perforations or cuts to facilitate tearing or breaking along the frangible line. The first detachable portion is preferably sufficiently wide to define a space between the adjacent carton wall and at least one edge of the second detachable portion, with the space being adequate to accommodate insertion of one or all of the consumer's fingers so that the consumer can grasp the second detachable portion for complete or partial detachment thereof. The first detachable portion is preferably at least sufficiently long to expose at least one entire edge of the second detachable portion, so that the consumer can grasp and pull the entire edge to reduce the chance of inadvertently bifurcating the second detachable portion when defining or reconfiguring the opening in the carton by either removing or partially detaching the second detachable portion. In some embodiments, the first detachable portion may be positioned such that one lengthwise edge of the first detachable portion is defined by and coincident with at least a portion of an edge of one or more carton walls. It will be appreciated that the first detachable portion may also be yieldable.

According to an aspect of certain embodiments of the invention, the second detachable portion is defined at least in part by the first severance line and a second severance line that enables the second detachable portion to be completely detached from the carton. The second detachable portion may be completely detached from the carton while preserving the ability of the then open carton to restrain the articles remaining therein. In certain embodiments, the second detachable portion is formed at least in part from an end wall. The end wall is more precisely an end closure structure formed from end panels hingedly connected to the carton walls. The first detachable portion may be detached from the carton without disturbing the integrity of at least a portion of the end wall. Thus, at least part of the end wall preferably remains in at least a partially upright position after the first detachable portion is detached and functions as an article retainer or stopper for blocking undesired exit of articles through the opening created by the detachment of the first detachable portion. In certain other embodiments, the second detachable portion is formed from a portion of two or more adjacent walls. Removal of the second detachable portion defines a rigid retention means defined by the remaining portions of the two or more adjacent walls.

According to an aspect of certain other embodiments of the invention, the second detachable portion is made partially detachable and yieldable by means of one or more separation means, such as severance lines, friction joints, perforations, tear tapes, or any other suitable separating mechanism that will be well known by those skilled in the art or is yet to be developed. Each separation means spans the distance from the first severance line to a wall adjacent to the first and second walls, and facilitates at least partial detachment or yielding movement of the second detachable portion. Thus, the second detachable portion is defined at least in part by the first severance line, by separation means, and by one or more fold lines that are integral to, or at an edge of an adjacent wall. Partial detachment frees the second detachable portion to yield so as to enlarge the opening when articles are being dispensed, and to reverse the enlargement by reducing the opening to prevent articles from falling through the dispenser opening when articles are not being dispensed. The reversal may be effected manually or automatically by means of the resilient memory of the carton material.

According to another aspect of the invention, removal or repositioning of the second detachable portion defines or reconfigures an opening for dispensing articles from the carton.

According to yet another aspect of the invention, removal or repositioning of the second detachable portion defines or creates a retention means for retaining articles in the carton.

According to another aspect of the present invention, the carton is formed from a blank having a first severance line at one end of the blank for defining the first detachable portion, as a well as a second severance line or severance means at the end of the blank that define the second detachable portion.

In certain embodiments, the first severance line is continuous and defines the first detachable portion as a relatively narrow and relatively long tear strip that is oriented transversely at least partially across the first side wall, completely across the top wall, and at least partially across the second side wall. At least a portion of one edge along the length of the first severance line is defined by and is coincident to the second severance line. The second severance line extends across at least a portion of an end flap hingedly connected to a first side wall, the second severance line originating on the distal edge and extending across the proximal edge of the first side end flap and onto the adjacent first side wall. The second severance line continues transversely from the first side wall, across the top wall, and then at least partially across the second side wall. The second severance line then turns and continues toward a second side end flap, terminating at the distal edge of the second end flap.

In certain other embodiments, the first severance line includes multiple frangible lines that extend across at least a portion of the second wall, which comprises end flaps and end wall panels. One such frangible line originates either on one side or on the distal end of its respective end flap and terminates on the other side of the end flap from which it originated. Another frangible line extends from the distal end of the end flap of the first panel onto the first panel and turns back to terminate at another point on the distal end of the end flap from which it originated. In certain embodiments, an additional frangible line extends from the distal end to the proximal edge of an end flap of the panel opposite the first panel. The frangible lines cooperate with one another when the carton is erected and the end flaps are folded together to define the first detachable portion.

In these embodiments, the blank also includes a fold line extending across or along an edge of at least a portion of at least one panel that is adjacent to the first and second walls of the erected carton. The fold line defines an axis of motion around which the second detachable portion can yield after the second detachable portion has been partially detached via the separation means, the separation means extending from the first severance means to or substantially near an end of the fold line in the adjacent panel.

According to yet another aspect of the invention, the first detachable portion has a tear initiation means connected or adjacent to at least one end to facilitate removal of the first detachable portion. Suitable tear initiation means include, but are not limited to, a push tab, a pull tab, flap, loop, any combination of tabs, loops or flaps, or an equivalent structure for gripping or grasping an end of a relatively thin or narrow structure. In the exemplary embodiments, the tear initiation means is formed by any combination of cuts, scores, and half cuts, and is integral to a carton wall and disposed at an end of the tear strip. For example, the tear initiation means can comprise a score line forming a substantially semicircular or triangular region, although other shapes may be used, that is bisected by a cut line or a frangible line such that a finger could penetrate the carton by applying pressure at the bisecting line thereby folding back the segments of the bisected semicircular or triangular region, thereby accessing the adjacent end of the first detachable portion. Once the finger is inside the carton and in contact with the first detachable portion, the finger can hook underneath the first detachable portion to pull outwardly, or a finger and a thumb can grasp the end of the first detachable portion, thereby initiating a tear to remove the first detachable portion. As another example, the tear initiation means comprises a frangible line forming a substantially semicircular tab (although other shapes may be used) through which a finger hole is disposed, the finger hole being defined by a substantially circular cutout, half-cut line, or other frangible line, such that a finger can penetrate the carton through the cutout, or by applying pressure to the frangible line (thereby displacing the small substantially circular portion of the carton bounded by the frangible line). In these embodiments, the tab is integral to and is a continuous portion of the end of the first detachable portion. Thus, by grasping and pulling the tab via the finger hole, the consumer can remove the entire tear strip.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 3 is a second perspective view of the carton formed from the blank of FIG. 1, showing removal of a first detachable portion.

FIG. 4 is a perspective view of a carton of the present invention formed from the blank of FIG. 1, the carton having been opened by removing a first and second detachable portion.

DETAILED DESCRIPTION

Figure 1:
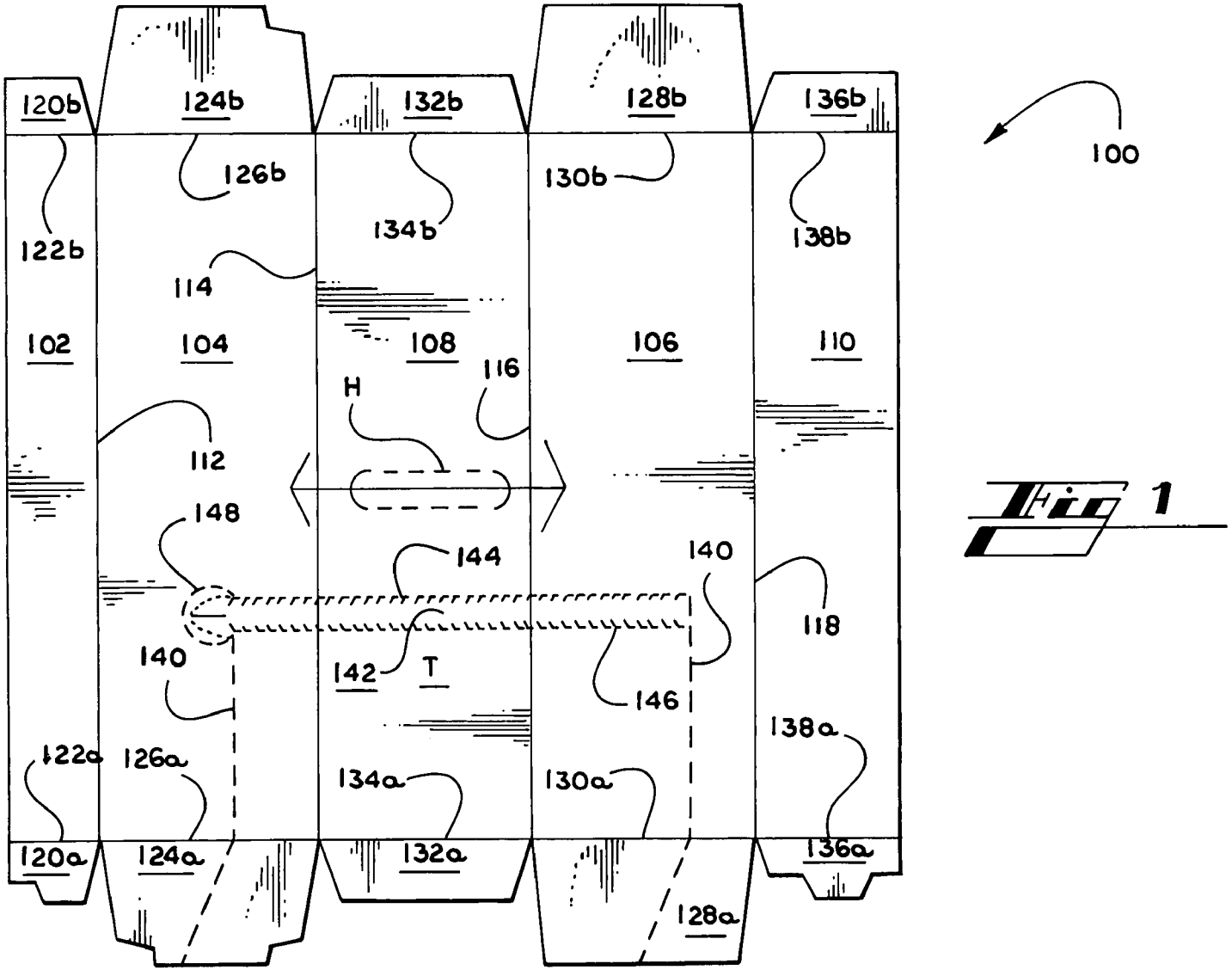
FIG. 1 is a plan view of a blank for forming the carton having a first detachable portion and a second detachable portion, according to one embodiment of the present invention.

Referring now to the drawings in which like numerals indicate like elements throughout the several views, the drawings show exemplary embodiments of cartons that illustrate certain of the various aspects of the present invention. In the embodiments described herein, the cartons are for dispensing articles such as beverage cans. Generally described, the cartons are formed from a foldable sheet material such as paperboard, corrugated board, plastic, or the like.

FIGS. 1 through 9 illustrate exemplary embodiments of cartons having a first detachable portion that defines an opening sufficiently large to remove one or more endmost articles, or to expose at least one edge of at least one second detachable portion. The second detachable portion is at least partially detachable to enlarge the opening, and also may be yieldable and so as to variably and reversible reconfigure the opening and to retain articles in the carton. Completely detaching the second detachable portion defines a stopper wall or other article stopper, which is preferably formed from the end of the carton.

Referring to a first embodiment shown as FIG. 1, carton 200 is formed from a paperboard blank 100. The blank 100 includes at least four primary panels for forming the carton 200. The panels of the blank 100 are a first bottom panel 102, a first side panel 104, a second side panel 106, a top panel 108, and a second bottom panel 110. The panels 102, 104, 106, 108, and 110 of the blank 100 are hingedly connected to one another. The bottom panel 102 is hingedly connected to the first side panel 104 by fold line 112. The first side panel 104 is then hingedly connected to the top panel 108 by fold line 114. The second side panel 106 is then hingedly connected to the top panel 108 by fold line 116. The second bottom panel 110 is then hingedly connected to the second side panel 106 by fold line 118. In the illustrated embodiments, a unitary blank is used to form a single carton, although it should be recognized that two or more blanks may be employed for example, to provide the dispenser structure described in more detail below.

Each of the panels 102, 104, 106, 108, and 110 includes opposing end flaps or end wall panels defined in part by transverse fold lines disposed in series along each longitudinal edge of the blank 100. When the carton 200 is erected, the end flaps and end wall panels cooperate to form an end closure structure. Each end closure structure is identical and therefore like references have been used, with "a" or "b" affixed to distinguish one end of the carton from the other. First bottom panel 102 is hingedly connected to end flap 120*a* along a fold line 122*a*. First side panel 104 is hingedly connected to end wall panel 124*a* along fold line 126*a*. Second side panel 106 is hingedly connected to end wall panel 128*a* along fold line 130*a*. Top panel 108 is hingedly connected to end flap 132*a* along fold line 134*a*. Second bottom panel 110 is hingedly connected to end flap 136*a* along fold line 138*a*.

Figure 2:
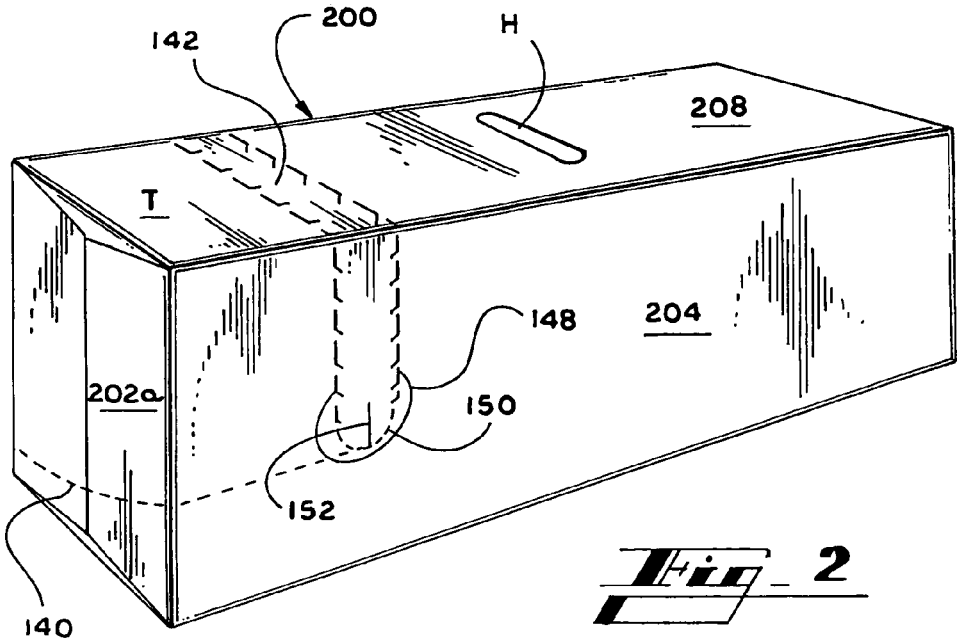
FIG. 2 is a perspective view of the carton formed from the blank of FIG. 1, showing the detail of a grasping means.

In order to erect the carton 200, first bottom panel 102 is glued or is otherwise secured to second bottom panel 110, to form the composite bottom wall 102/110 of open ended tubular carton 200. After the articles are grouped and loaded through either or both of the open ends of the carton 200, the end flaps and end wall panels are folded and secured together to form opposing end closure structures of carton 200. End flap 120*a* is secured to end flap 136*a* whereas end wall panel 124*a* is secured to end wall panel 128*a*. Additionally, end flaps 120*a*, 132*a*, and 136*a* may optionally support the integrity of the carton by being secured to end wall panel 124*a* and to end wall panel 128*a*. The end flaps 120*b*, 132*b* and 136*b*, and end wall panels 124*b* and 128*b*, cooperate similarly to form the opposing end closure structure. Referring now to FIG. 2 (showing the carton 200 in an unopened condition), the end closure structures form respective end walls 202*a* and 202*b* (not shown).

The cartons illustrated in the drawings are adapted to hold a group of similarly dimensioned, preferably cylindrical articles (such as cans or bottles), in one or more vertically arranged rows and one or more horizontally arranged columns. The articles in each row are disposed on their sides in a side-by-side parallel fashion. Referring again to FIG. 2, side walls 204 and 206 are disposed alongside the ends of the articles of the group, while each end wall 202*a* and 202*b* of the carton is disposed adjacent to the side walls of the respective endmost column of articles.

Referring again to FIG. 1, the blank 100 includes a frangible severance line 140, which when the carton is erected, defines a detachable portion T. To define and provide a means for separating detachable portion T, the severance line 140 extends substantially diagonally from the distal edge of end wall panel 124*a* towards top panel 108, crosses fold line 126*a* onto side panel 104, turns to longitudinally traverse a portion of side panel 104, turns toward top panel 108, crossing fold line 114 to transversely traverse top panel 108, crosses fold line 116 onto side panel 106, turns toward end wall panel 128*a*, crosses fold line 130*a*, extends substantially diagonally toward end flap 132*a* and terminates at the distal edge of end wall panel 128*a*. It is contemplated that the severance line 140 includes, but is not limited to, a line of perforations, a score line, a line of short slits, a line of half cuts, a single half cut, any combination of slits, score lines, and half cuts, or the equivalent.

The blank 100 further comprises a suitable known handle H to allow the user to carry the carton.

The blank 100 also includes at least one relatively long and relatively narrow removable tear strip 142 defined by a second frangible severance line 144, at least a portion of which is coincident with severance line 140. In preferred embodiments, a portion of severance line 144 defining one entire side of tear strip 142, i.e., a segment that spans the entire length of tear strip 142 is coincident with the upper edge 146 of severance line 140 as viewed in FIG. 1.

The blank 100 preferably includes one or more tear or severance initiation means 148, such as push tabs that function as a grasping means for grasping the end of the tear strip, shown in more detail in FIGS. 2 and 3 and described below.

To open the carton of FIG. 2, the user takes hold of tear strip 142 via severance initiation means 148. Once the user has grasped the end of the tear strip 142, the user pulls the tear strip up a portion of the side wall 204, over the top wall 208, and down the side wall 206 until the tear strip 142 is completely detached from the carton 200, as shown in FIG. 3, leaving a space or gap having the width of tear strip 142. An edge of the gap coincides with an edge of detachable portion T, thereby enabling the user to grasp the detachable portion T, pulling it away from the carton 200 to separate the detachable portion T along severance line 140.

FIG. 3 also shows the detail of a severance initiation means 148. The severance initiation means 148 shown comprises a score or fold line 350 forming a substantially semicircular or triangular region (although other shapes may be used) that is bisected by a cut line or other frangible line 352, although any suitable configuration can be utilized to enable the user to insert at least one finger or otherwise gain access to grip an end of the tear strip 142. Applying pressure to cut line 352 causes flaps 302 and 304 to fold into the carton, thereby creating a finger hole through which an inserted finger can access and pull an end of the tear strip 142 to at least remove the tear strip 142, as FIG. 3 depicts. Preferably, the width of the space formed by removing the tear strip 142 is sufficient to enable the user to then insert as many as all of the user's fingers into the space in order to grasp the upper edge 146 of the detachable portion T. The user then pulls the detachable portion T toward end wall 202*a*, and then downwardly until the entire detachable portion T has been completely detached from carton 200, as shown in FIG. 4.

Detachment of the detachable portion T defines opening O and forms side wall recesses 404 and 406 that are not identical to one another. Rather, the lowest point of side wall recess 404 is distanced from composite bottom wall 102/110 by less than or equal to half the diameter of an article C. The lowest point of side wall recess 406 is distanced from composite bottom wall 102/110 by greater than or equal to the diameter of an article C. Thus, because of the depth of recess 404 a user can easily access the articles on the lowermost row of the carton 200 by grasping the article C at the end of the article that is adjacent to side wall 204. The relatively shallower recess 406 provides additional stability and capacity for retaining articles in the carton 200.

The lower portion of the front end wall 202*a* forms a stopper wall 412 that extends upwardly from the composite bottom wall 102/110 between the side walls 204 and 206. The upper edge 414 of the stopper wall 412 as defined by the end wall section of severance line 140 slopes or curves substantially diagonally from its lowest point (less than or equal to one half the diameter of one article) at fold line 130*a* to its highest point (greater than or equal to the diameter of one article) at fold line 126*a*. Thus, the stopper wall 412 prevents the articles C in the lowermost row from inadvertently exiting the carton 200 before intended removal.

Figure 6:
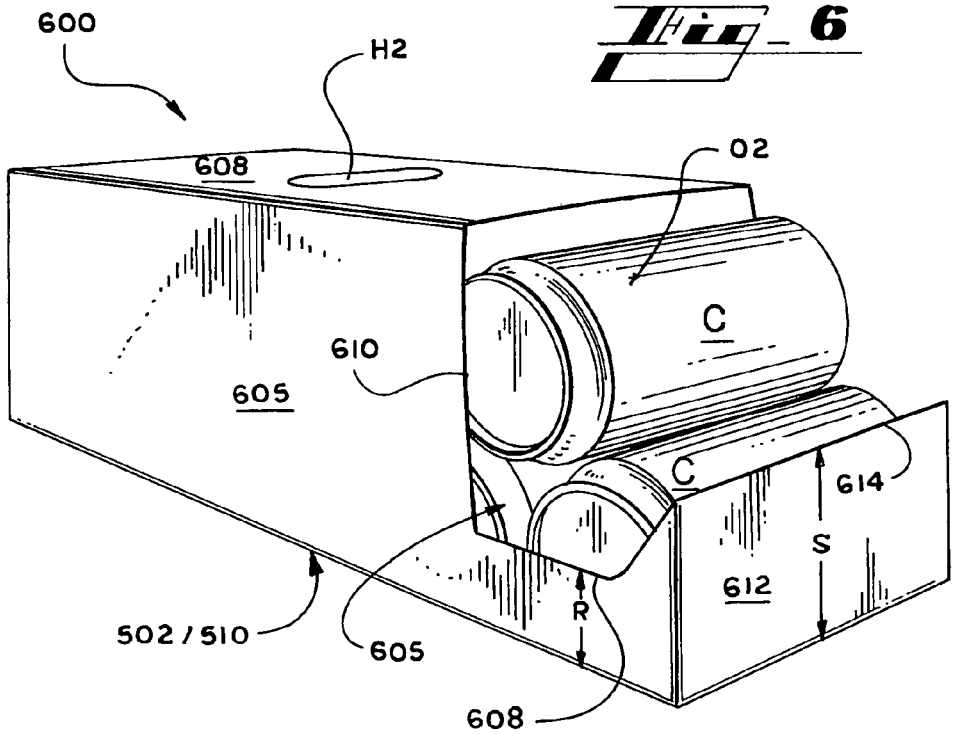
FIG. 6 is a perspective view of a carton of the present invention formed from the blank of FIG. 5, having been opened by removing a first and second detachable portion.
Figure 5:
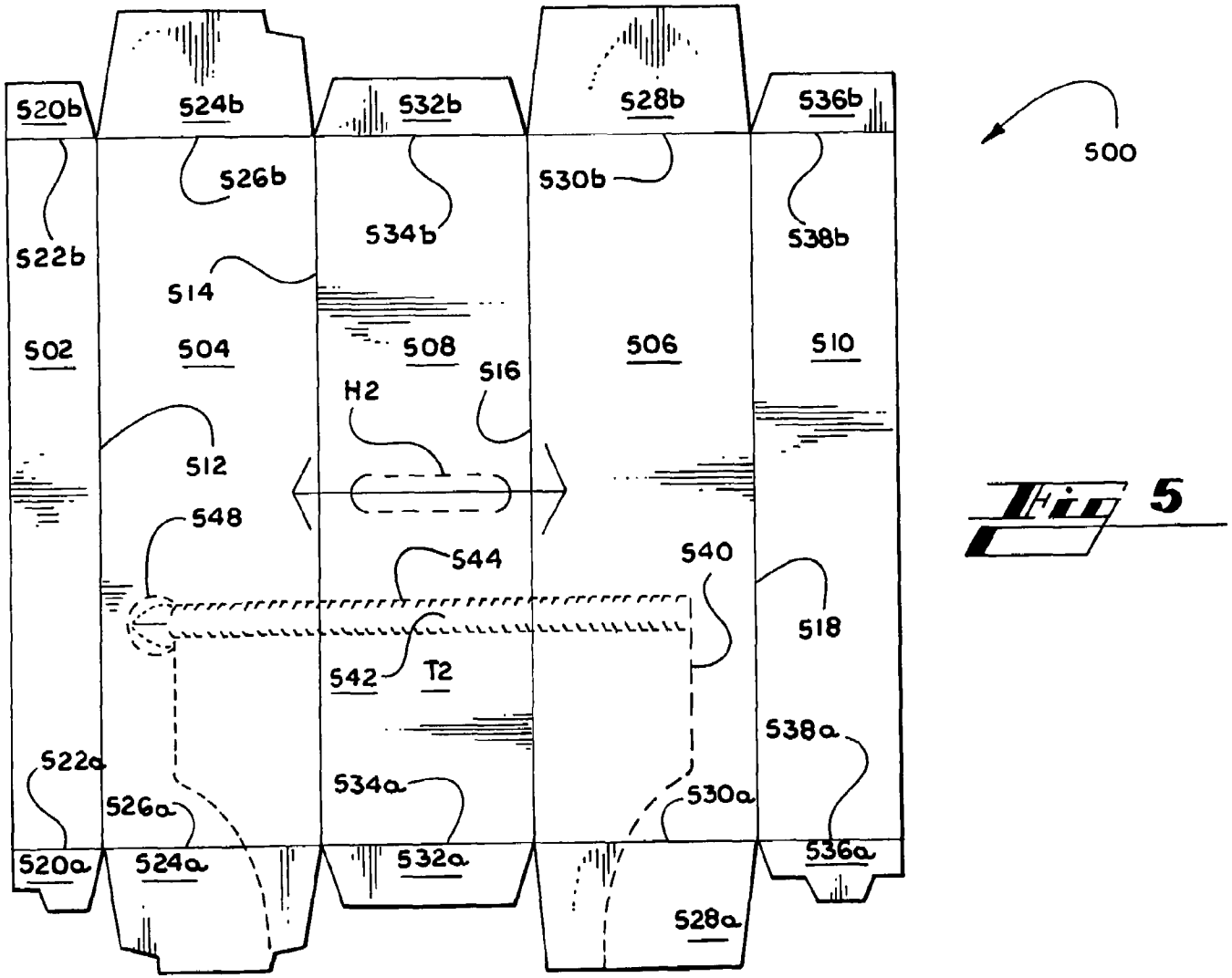
FIG. 5 is a plan view of an alternative embodiment of a blank having a first detachable portion and a second detachable portion.

FIGS. 5 and 6 illustrate an alternative embodiment of a blank 500 for forming another carton 600 of the present invention, and like references have been used with the prefix "5" in FIG. 5, and the prefix "6" in FIG. 6. The blank 500 is similar to blank 100, described above, except that the blank 500 includes a severance line 540, which when the carton is erected, defines a detachable portion T2. To define detachable portion T2, the severance line 540 curves from the distal edge of end wall panel 524*a* towards but does not reach first bottom panel 502, crosses fold line 526*a* onto side panel 504, turns to longitudinally traverse a portion of side panel 504, turns directly toward top panel 508, crossing fold line 514 to transversely traverse top panel 508, crosses fold line 516 onto side panel 506, turns directly toward end wall panel 528*a*, and curves toward but does not reach top panel 508 as it crosses fold line 530*a* and terminates at the distal edge of end wall panel 528*a*.

The blank 500 further comprises a suitable known handle H2 to allow the user to carry the carton.

Referring now to FIG. 6, the carton 600 differs from carton 200 primarily in that carton 600 has an opening O2 that is shaped differently than opening O described above. The segment of the severance line 540 that traverses side wall 605 (hereinafter referred to as a "side wall severance line") defines a recess 606 that has a bottom edge 608 that is parallel to the adjacent side edge of the composite bottom wall 502/510, the bottom edge 608 preferably being at a distance R from the composite bottom wall 502/510, where R is less than or equal to one half the diameter of each of the articles C enclosed by the carton 600. Thus, the depth of the recess 606 enables the user to gain access to the articles C in the lowermost row by gripping both ends each article for removal. The side wall severance line extends to the connection of the respective side wall 606 with end wall 602*a* (not shown) at a distance above the composite bottom wall 502/510 that is generally greater than or preferably substantially equal to on half the diameter of each one of the articles C enclosed by the carton 600. Preferably, the distance between vertical edge 610 of the recess 606 and the end wall 602*a* is greater than twice the diameter of a single article C, and is positioned so as to expose at least two articles C on the lowermost row, thereby facilitating removal of articles C from the lowermost row in the article group.

By removing or detaching the detachable portion T2, the end portion of the carton is exposed to provide dispenser opening O2 for the articles so that the user can gain access to the articles C in the uppermost row. Furthermore, the lower portion of the front end wall 602*a* forms a stopper wall 612 that extends upwardly from the composite bottom wall 502/510 between the side walls 604 and 605. The upper edge 614 of the stopper wall 612 is defined by the end wall section of severance line 540 so that the stopper wall 612 alone is capable of inhibiting the articles C in the lowermost row or rows from inadvertently exiting the carton 600 before intended removal, and so that the contents of the carton 600 are easily viewed through the dispenser opening O2. The highest point along the upper edge 614 is spaced at a distance S above the composite bottom wall 502/510, where S is greater than or preferably substantially equal to the diameter of one article C. The distance S is greater than the distance R.

Figure 7:
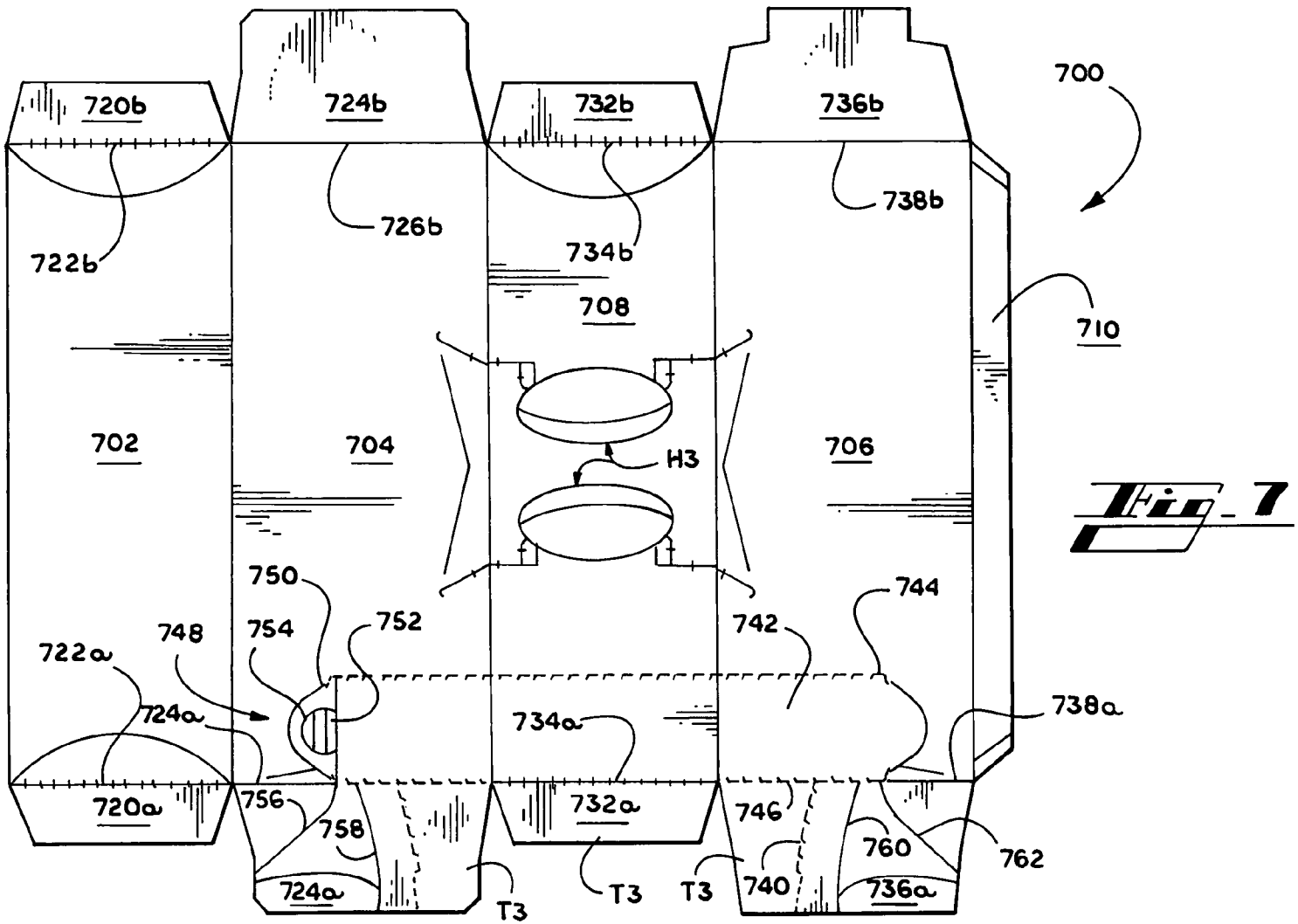
FIG. 7 is a plan view of a third alternative embodiment of a blank having a first detachable portion and a second detachable portion, wherein the second detachable portion is yieldable.
Figure 8:
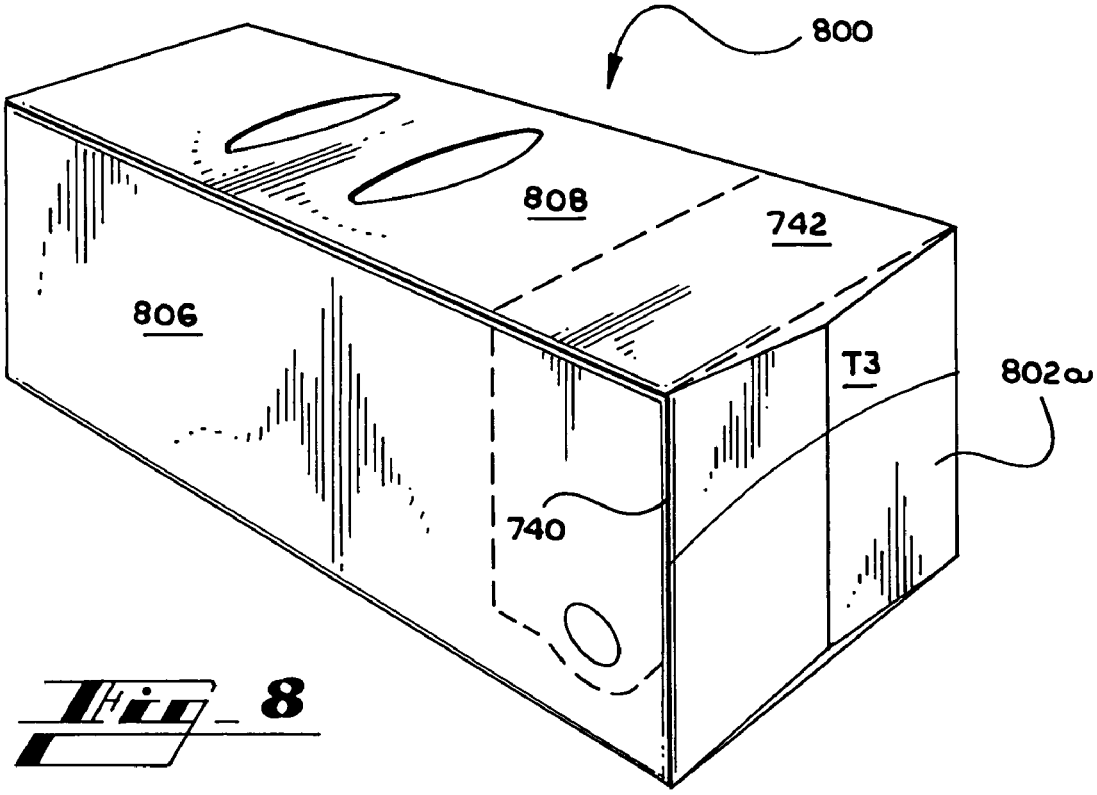
FIG. 8 is a perspective view of a carton formed from the blank of FIG. 7.
Figure 9:
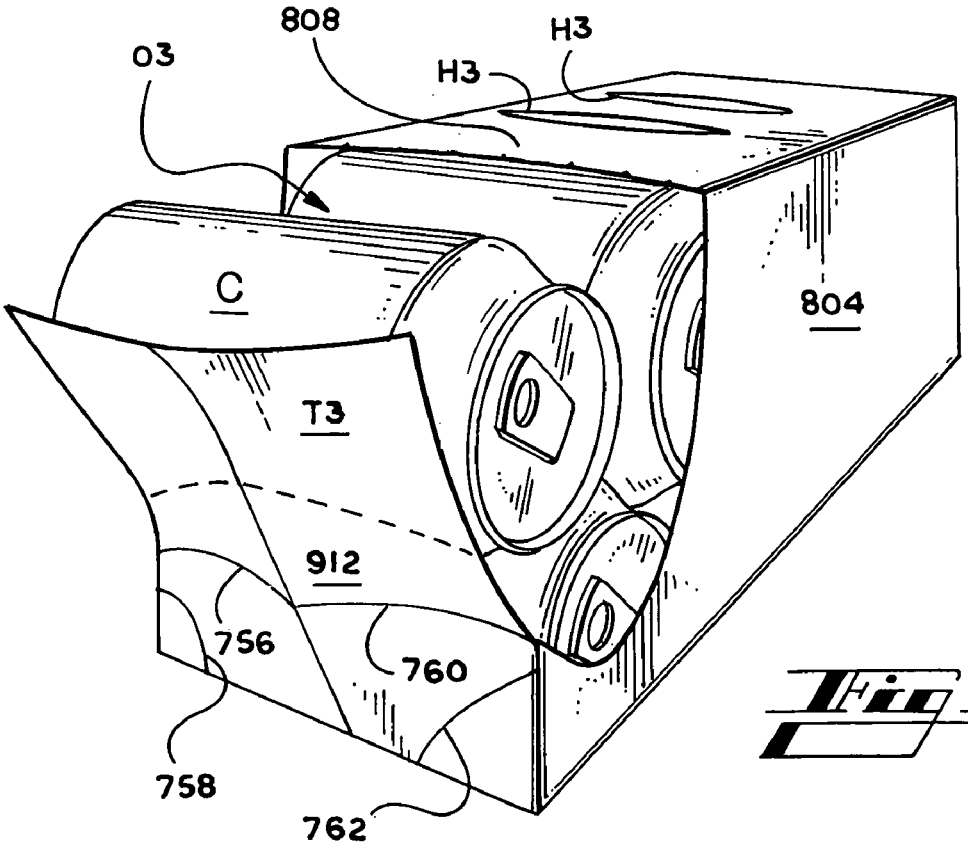
FIG. 9 is a perspective view of the carton of FIG. 9, formed from the blank of FIG. 7, and opened by removing a first detachable portion.

FIGS. 7, 8, and 9 illustrate an alternative embodiment of a blank 700 for forming another carton 800 of the present invention. The blank 700 is similar to blank 100, but includes a relatively larger first detachable portion shown as tear strip 742. The tear strip 742 is defined by a severance line 744 and is positioned such that its one side edge that is coincident with the severance line 740 comprises a portion of fold line 724*a*, the entirety of fold line 732*a*, and a portion of fold line 738*a*. Thus the upper edge 746 of detachable portion T3 also comprises the same portion of fold line 724*a*, the entirety of fold line 732*a*, and the same portion of fold line 738*a*.

To define second detachable portion T3 (which comprises at least portions of end wall panels 724*a* and 736*a* and end flap 732*a*), the severance line 740 curves from the distal edge of end wall panel 724*a* towards (without reaching) bottom panel 702, turns to follow fold line 724*a* toward top panel 708 along an edge of side panel 704, follows fold line 732*a* toward side panel 706 along an edge of top panel 708, follows a portion of fold line 738*a* toward edge flap 710, and turns toward the distal edge of end wall panel 736*a*, while curving towards end flap 732*a*. As shown in FIG. 8, when carton 800 is erected, detachable portion T3 comprises an upper portion of the end closure structure comprising end wall 802*a*.

Blank 700 also includes an alternative severance initiation means 748, which is a tab 750 through which is disposed a finger hole 752 that is defined by a cut or severable line 754. Thus, the grasping means 748 is essentially a loop. Although the tab 750 shown is semicircular or rounded, any shape through which the finger hole 752 of suitable size can be disposed can be utilized. To remove the tear strip 742, the user simply inserts a finger into finger hole 752, preferably displacing the center section, and pulls the tear strip 742, which is integral to the grasping means 748. As the figure illustrates, prior to being accessed, the finger hole 752 may be occluded to prevent infiltration of light and debris. The occluding material may include fold lines to facilitate its being punched out to access finger hole 752.

The blank 700 further comprises a suitable handle H3 to allow the user to carry the carton.

Referring now to FIG. 9, removal of tear strip 742 creates opening O3, through which the endmost article or articles on the uppermost row are made accessible. Removal of tear strip 742 also defines stopper wall 912, which in combination with detachable portion T3, has the advantage of being of sufficient height and stability to constrain even the first article after removal of the tear strip 742. After the first article has been taken out of the carton 800, opening O3 preferably can be enlarged by removal of detachable portion T3 along tear line 740.

Referring again to FIG. 7, this embodiment has the added advantage of score lines 756 and 758 on end wall panel 724*a* and of score lines 760 and 762 on end wall panel 736*a*. These score lines cause stopper wall 912 and detachable portion T3 to yield so as to flex or bow outward in such a manner as to present the articles for easier access by the user. Score lines 758 and 760 are substantially parallel to the portions of severance line 740 that cross the respective end wall panels 724*a* and 736*a*. Score line 756 extends from the proximal end of end wall panel 724*a* and curves away from score line 758, terminating on the side of end wall panel 724*a*. Score line 762 extends from the proximal end of end wall panel 736*a* and curves away from score line 760, terminating on the side of end wall panel 736*a*.

FIGS. 10 through 23 illustrate exemplary embodiments of cartons having a first detachable portion that defines an opening for removing articles, and at least one second detachable portion that is yieldable and at least partially detachable so as to variably and reversible reconfigure the opening and to retain articles in the carton.

Figure 10:
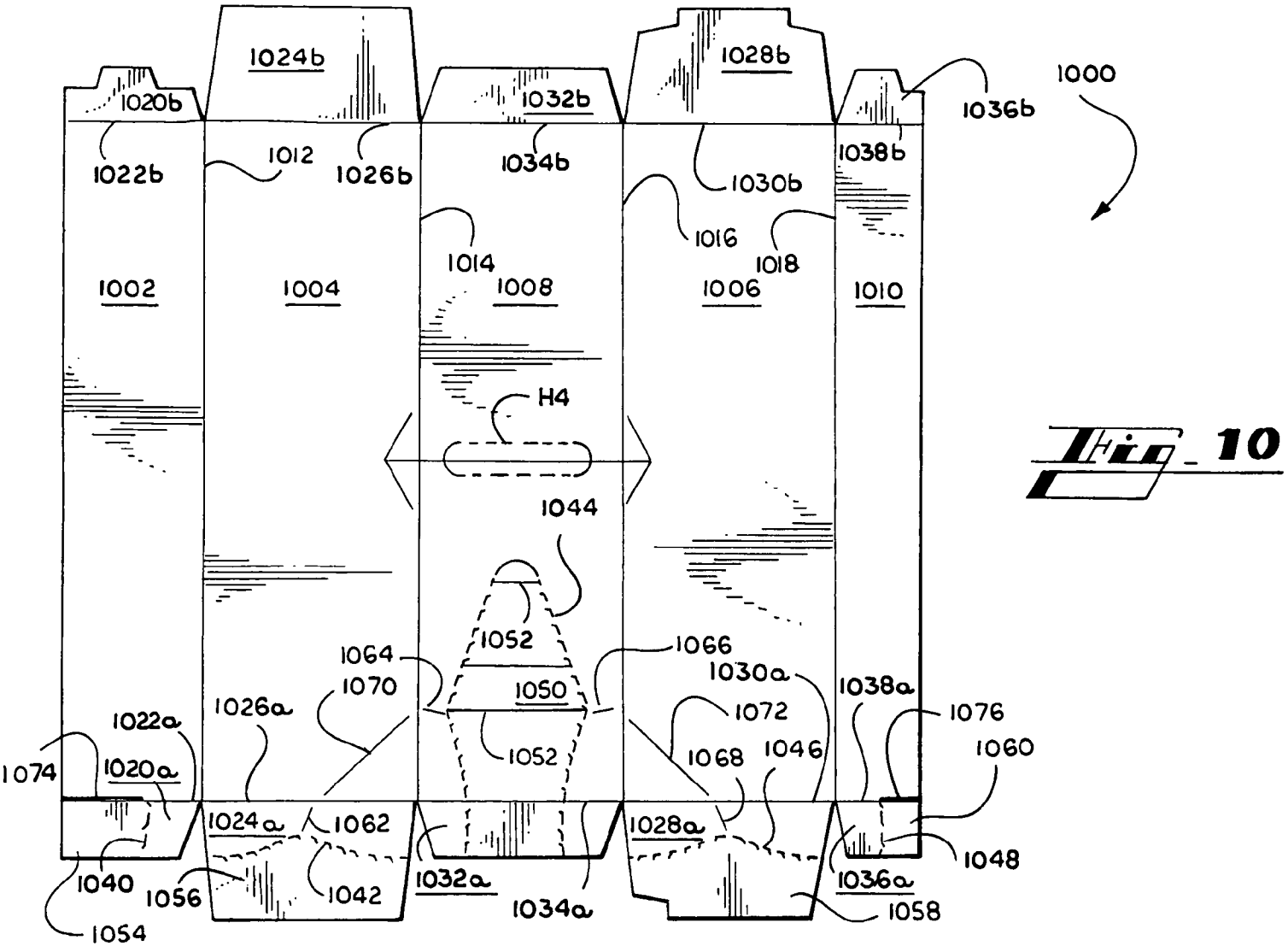
FIG. 10 is a plan view of an embodiment of a blank for forming carton having a first detachable portion and at least one second detachable portion that is yieldable and partially detachable.

Referring to FIG. 10, the blank 1000 includes frangible lines 1040, 1042, 1044, 1046, 1048, 1074, and 1076, which when the carton 1100 is erected, cooperate to form a single continuous severance line 1140 that defines a fully detachable portion (shown in FIG. 11), which extends partially across top wall 1108 and end closure structure 1102*a*. The severance line 1140 also extends at least partially across the top wall 1108 and end closure structure 1102*a*. Frangible line 1044 defines the upper section 1050 of the fully detachable portion, which preferably includes one or more horizontal score lines 1052 to facilitate the initiation of a tear. Each of the frangible lines 1040, 1042, 1044, 1046, 1048, 1074, and 1076 may be a line of severance lines or any other weakened line that facilitates separation along the frangible lines 1040, 1042, 1044, 1046, 1048, 1074, and 1076. It is contemplated that the severance line 1140 includes, but is not limited to, a line of perforations, a score line, a line of short slits, a line of half cuts, a single half cut, any combination of slits, score lines, and half cuts, or the equivalent.

To define portion 1050, the frangible line 1044 extends from the distal end of end flap 1032*a*, across fold line 1034*a*, onto the top panel 1008, and then turns back without intersecting itself to again cross fold line 1034*a* and to terminate at another point on the distal end of the same end flap 1032*a*. Therefore, frangible line 1044 is intersected twice by fold line 1034*a*. The portion 1050 includes a peak just above the uppermost fold line 1052. When pressed, the peak collapses inwardly along the uppermost fold line 1052 to form a tab that can be grasped to remove portion 1050 along frangible line 1044.

Frangible lines 1042 and 1046 extend at least partially across each of the end wall panels 1024*a* and 1028*a* of opposing side panels 1004 and 1006, originating on one side edge each respective end wall panel and terminating on the opposite side edge of the end wall panel from which it originated. Each of frangible lines 1040 and 1048 extends from the respective distal end of end flap 1020*a* or 1036*a* to its adjacent panel 1002 or 1010. Frangible lines 1074 and 1076 free the lower end of the fully detachable portion.

Figure 11:
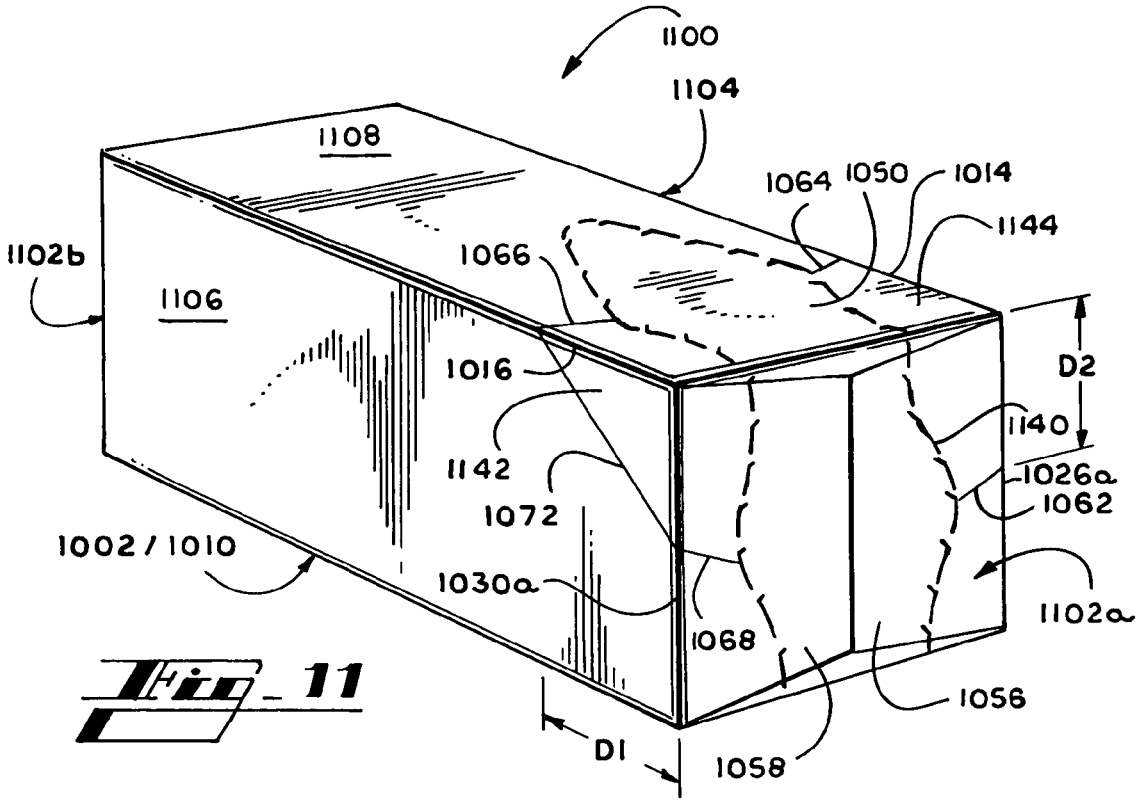
FIG. 11 is a perspective view of a carton formed from the blank of FIG. 10.
Figure 14:
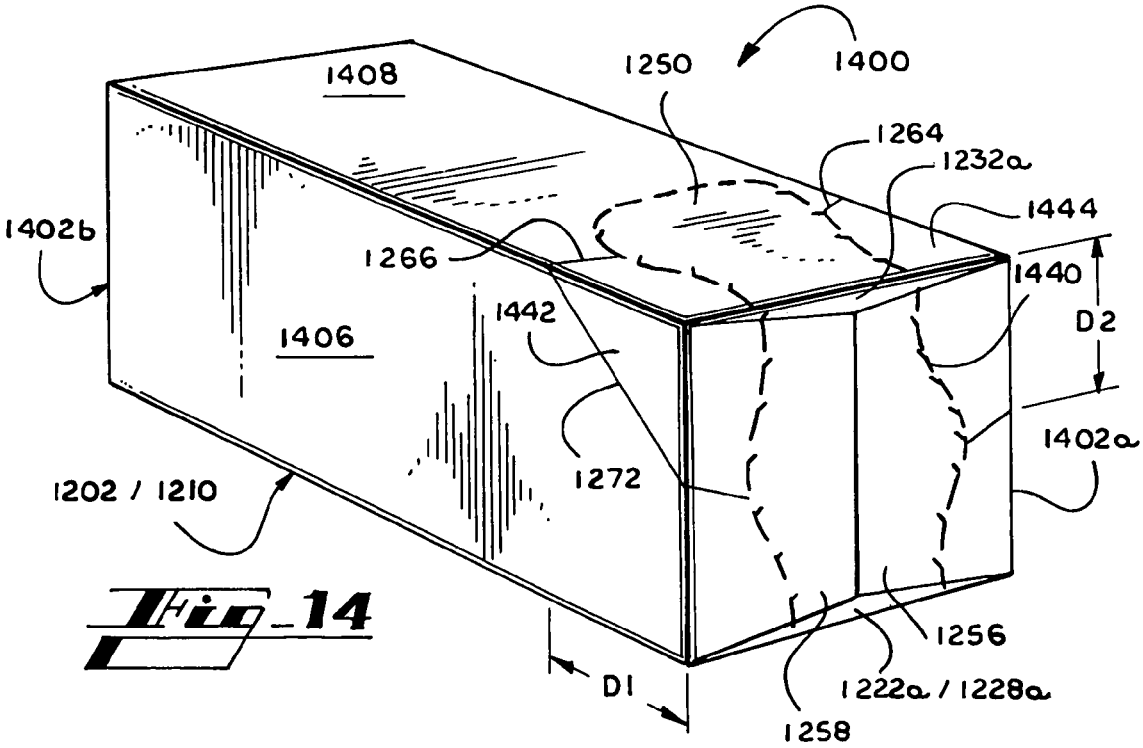
FIG. 14 is a perspective view of a carton of the present invention formed from the blank of FIG. 12.

Portions of the frangible line 1044 across end flap 1032*a* and adjacent fold line 1034*a* are preferably arched or curved somewhat inward relative to one another so that the portion 1050 is somewhat narrower at the distal ends of end flap 1032*a*. Referring now to FIG. 11, when carton 1100 is erected and end wall panels 1024*a* and 1028*a* are folded and secured to one another, portion 1050 cooperates with portions 1054, 1056, 1058, and 1060 along frangible lines 1040, 1042, 1044, 1046, 1048, 1074, and 1076 to define a fully detachable portion. The frangible lines 1040, 1042, 1044, 1046, 1048, 1074, and 1076 combine to define a continuous or endless frangible line 1140 about the periphery of the fully detachable portion of the carton 1100.

As can be seen in FIG. 11, yieldable portions 1142 and 1144 that facilitate retention and removal of articles from the carton 1100 are each formed from a portion of end closure structure 1102*a*, top wall 1108, and a respective adjacent side wall 1106 or 1104. At least one separation means 1062, 1064, 1066, and 1068 extends from the continuous frangible line 1140 formed by frangible lines 1040, 1042, 1044, 1046, 1048, 1074, and 1076 to the side wall 1104, 1106 adjacent to each respective yieldable portion 1142, 1144, thereby enabling partial detachment of the yieldable portion 1142, 1144 of the carton 1100.

Each separation means 1062, 1064, 1066, and 1068 is positioned at or near a natural stress point that would occur on a carton having no separation means if a user were to attempt to remove an article through the opening formed by removal of fully detachable portion 1050. In preferred embodiments, the dimensions and positioning of partially detachable portions 1142, 1144 are also related to the dimensions of the articles (not shown) enclosed within carton 1100. Each of partially detachable portions 1142, 1144 has a depth, as defined as the distance D1 from the respective separation means 1064, 1066 to the end closure structure 1102*a*, measured along respective fold lines 1014, 1016. The distance D1 is preferably less than or substantially equal to the diameter of one cylindrical article. Each of partially detachable portions 1142, 1144 has a height that is defined as the distance D2 from the respective separation means 1062, 1068 to the top wall 1108, as measured along fold line 1026*a*, 1030*a*. The distance D2 is preferably also less than or substantially equal to the diameter of one cylindrical article. It should be noted that the dimensions of the partially detachable portions of the embodiments shown in FIGS. 14, 16, 18, 19, 20, and 22 are similarly determined.

Partial detachment of yieldable second detachable portions 1142, 1144 allows movement of thereof along fold lines 1070, 1072 in each respective side wall 1104, 1106. Partially detachable yieldable portion 1142 is defined by frangible line 1046, separation means 1068, fold line 1072, separation means 1066, and a portion of frangible line 1140. Similarly, partially detachable yieldable portion 1144 is defined by frangible line 1042, separation means 1062, fold line 1070, separation means 1064, and a portion of frangible line 1140.

In a variation of the embodiment shown in FIGS. 10 and 11, additional yieldable portions can be similarly formed from the end closure structure 1102*a*, bottom wall 1002/1010, and the adjacent side walls 1104, 1106 to facilitate removal of articles from carton 1100 from below.

Figure 12:
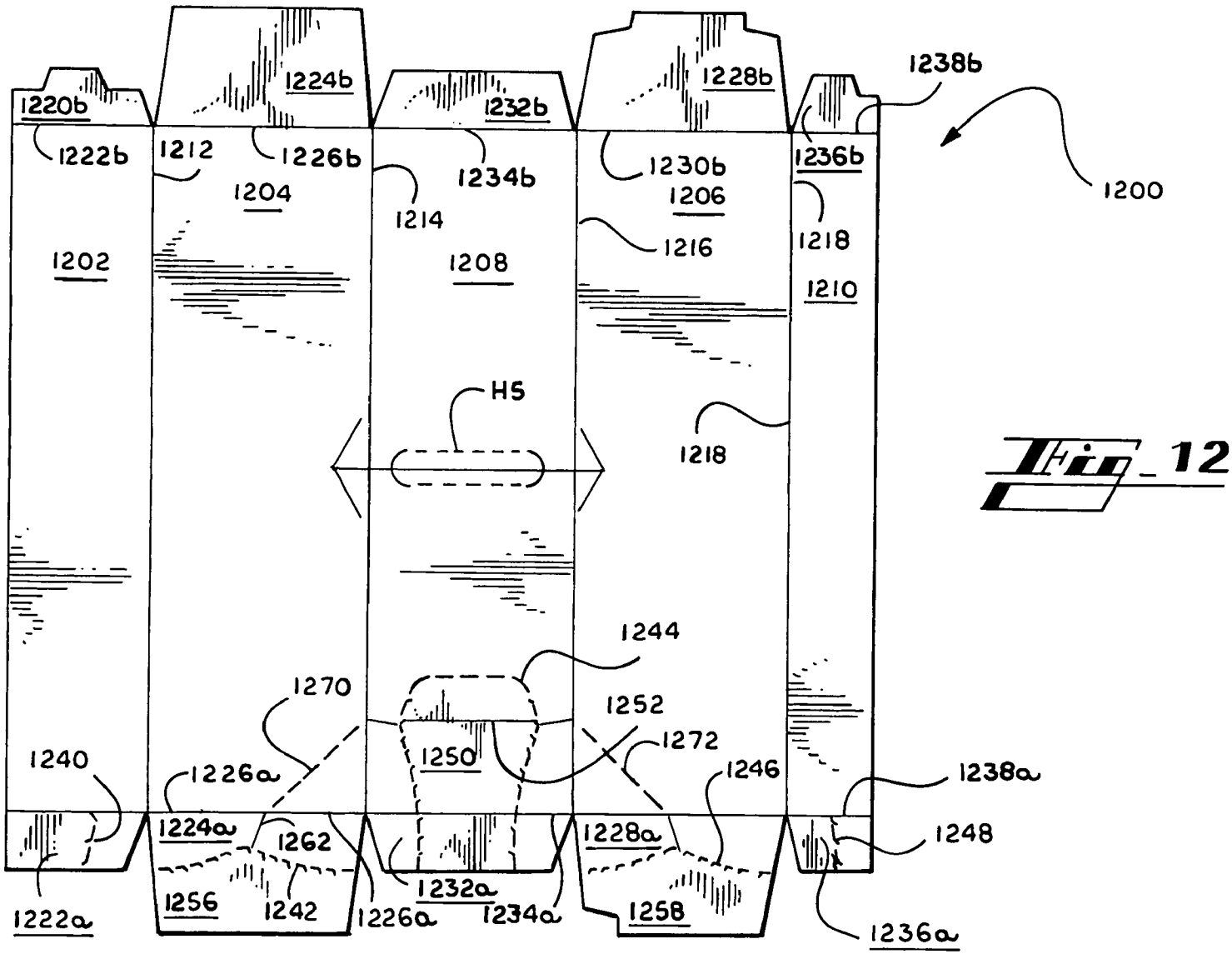
FIG. 12 is a plan view of a blank for forming an alternative embodiment of a carton having a first detachable portion and at least one second detachable portion that is yieldable and partially detachable.

As shown in FIG. 12, blank 1200 is an alternative embodiment for forming a carton 1300 having a first detachable portion 1250 and at least one second detachable portion 1342, 1344 that is yieldable and partially detachable. At least a section of the first detachable portion 1250 is shaped differently than the corresponding section of first detachable portion 1050 described above. The blank 1200 is similar to blank 100, described above, except that frangible line 1244 defines a blunt upper edge as opposed to the peaked upper edge defined by frangible line 1044, and that a single fold line 1252 extending across the upper section of fully detachable portion 1250 aids in tear initiation and in detachment. The yieldable portions defined by frangible lines 1240, 1242, 1244, 1246, and 1248 also have a different shape due to the change in shape of severance line 1440 (shown in FIG. 14).

Figure 13:
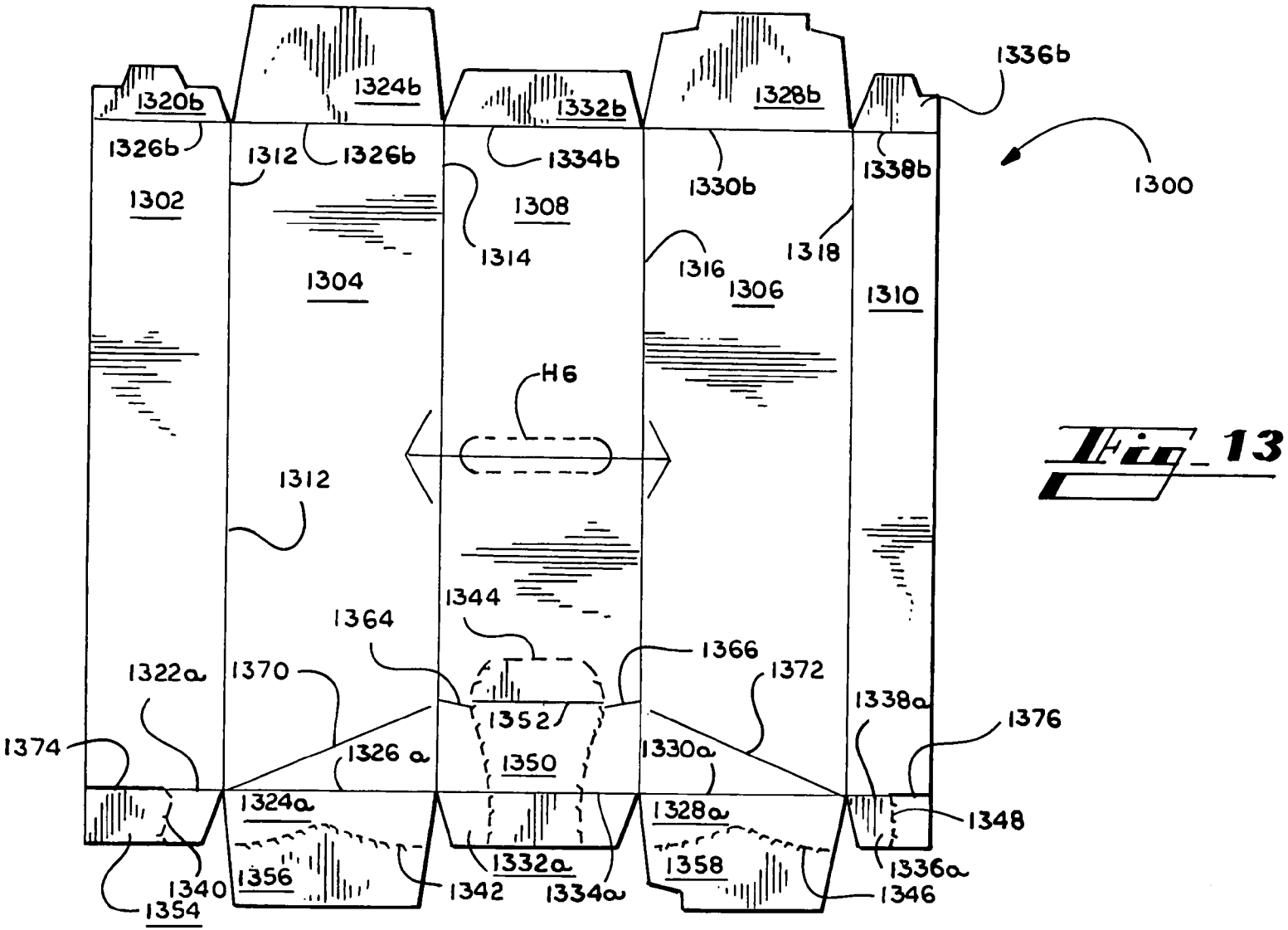
FIG. 13 is a plan view of a blank for forming a third alternative embodiment of a carton having a first detachable portion and at least one second detachable portion that is yieldable and partially detachable.

FIG. 13 illustrates an alternative embodiment 1300 of blank 1200. First detachable portion 1350 defined by frangible lines 1340, 1342, 1344, 1346, and 1348 has the same shape as fully detachable portion 1250 described above. The blank 1300 is similar to blank 1200, described above, except that only two separation means 1364, 1366 are required to partially detach opposing yieldable portions because fold line 1370 and fold line 1372 each extend completely across respective side panels 1304 and 1306. Fold line 1370 extends from separation means 1364 across side panel 1304, and terminates at the intersection of fold lines 1326*a* and 1312. Fold line 1372 extends from separation means 1366 across side panel 1306, and terminates at the intersection of fold lines 1330*a* and 1318. This alternative creates potentially larger yieldable portions, which requires less effort and fewer steps on the part of the consumer to partially detach each yieldable portion. In a variation of this embodiment, additional separation means may be provided along the fold lines 1322*a* and 1338*a*. At least one fold line 1352 may extend across the upper section of the first detachable portion 1350 to facilitate initiation of a tear.

Figure 15:
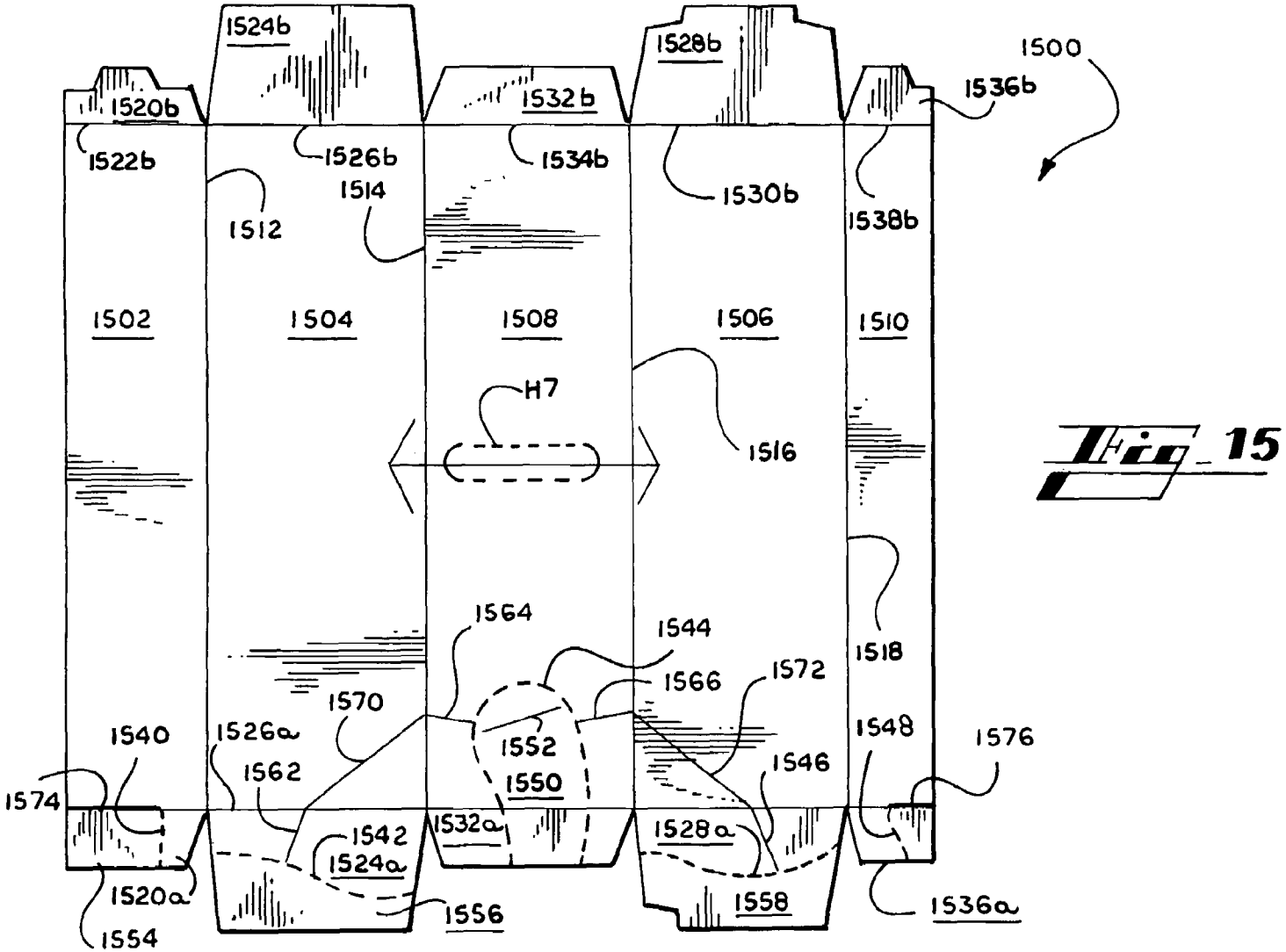
FIG. 15 is a plan view of a blank for forming a fourth alternative embodiment of a carton having a first detachable portion and at least one second detachable portion that is yieldable and partially detachable.
Figure 16:
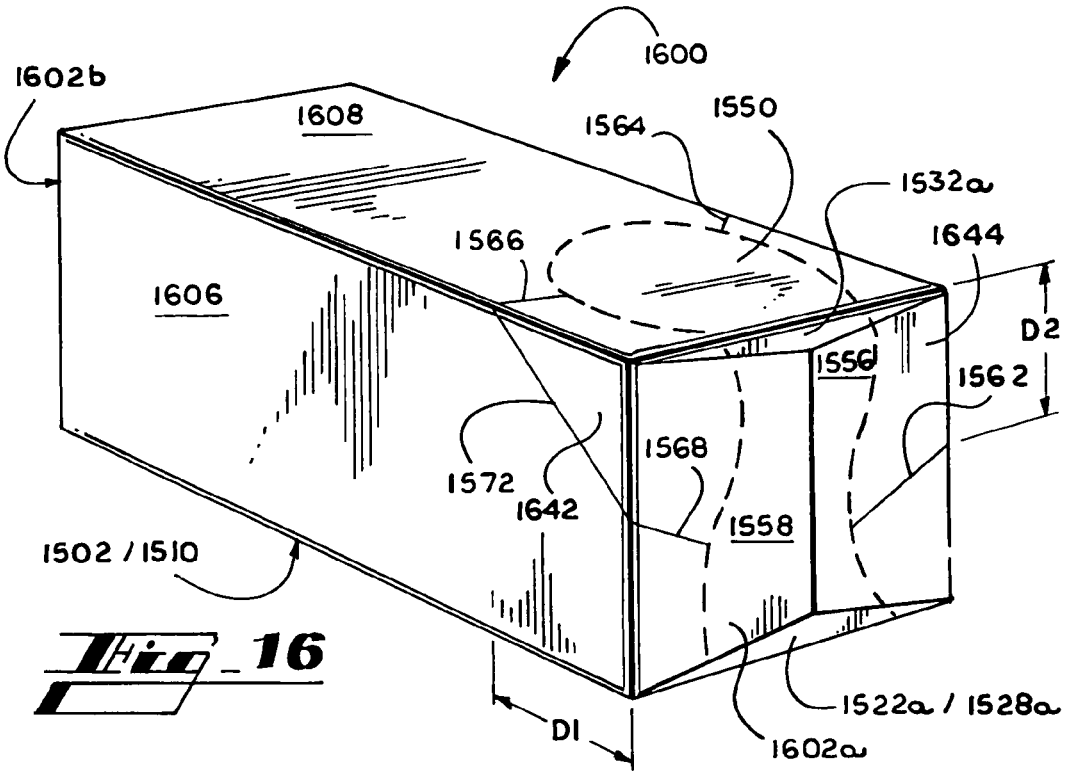
FIG. 16 is a perspective view of a carton of the present invention formed from the blank of FIG. 15.
Figure 18:
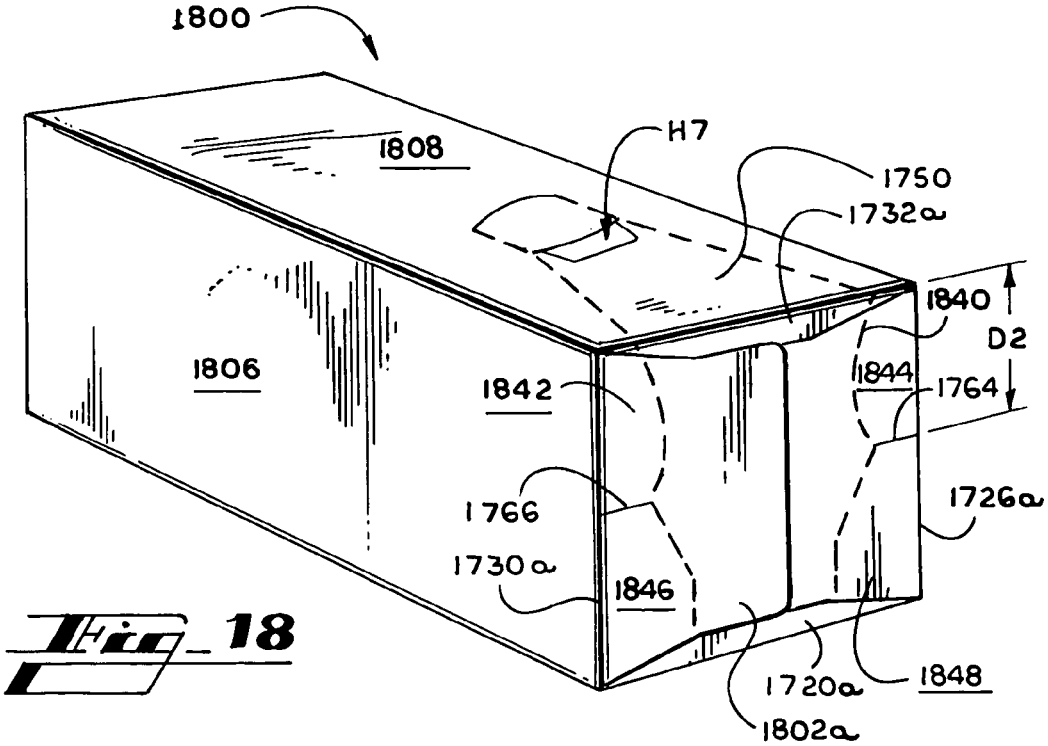
FIG. 18 is a perspective view of a carton of the present invention formed from the blank of FIG. 17.
Figure 17:
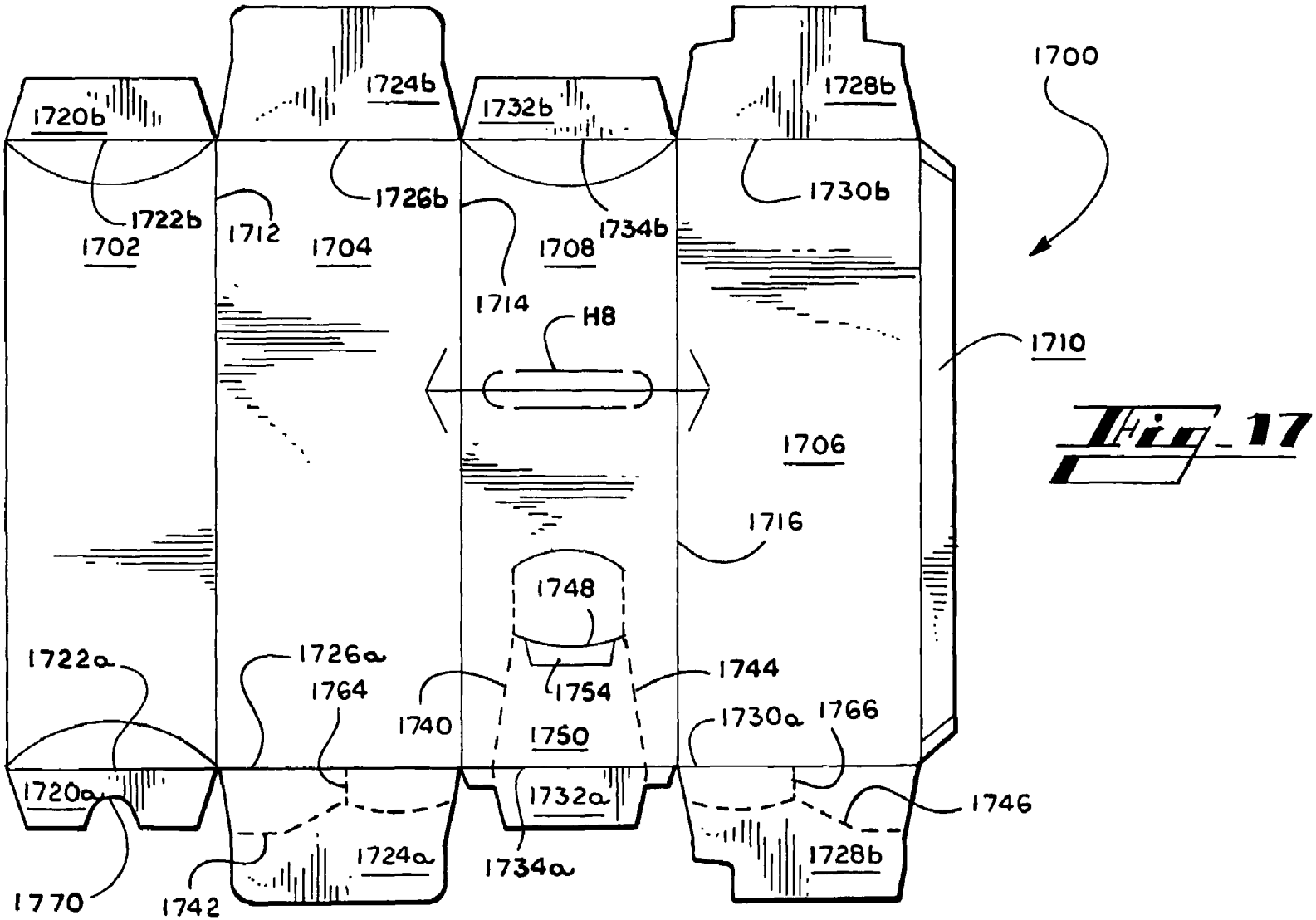
FIG. 17 is a plan view of a blank for forming a fifth alternative embodiment of a carton having a first detachable portion and at least one second detachable portion that is yieldable and partially detachable.

FIGS. 15 and 16 illustrate a blank 1500 for forming the carton 1400 having a first detachable portion 112 the removal of which creates an opening that has a creative shape that may approximate a decorative design such as a trademarked logo or the silhouette of an object. The blank 1500 is similar to blanks 1000, 1200 and 1300, described above, except that frangible lines 1540, 1542, 1544, 1546, 1548, 1574, and 1576 cooperate when the carton 1600 is erected to form continuous frangible line 1640, the shape of which forms the decorative design or creative shape. In yet another alternative embodiment shown in FIGS. 17 and 18, a blank 1700 for forming carton 1800 includes a fully detachable portion 1750 that is detached by means of frangible lines 1740, 1742, 1744, and 1746, which cooperate when carton 1800 is erected to form continuous frangible line 1840 which defines fully detachable portion 1750. This embodiment also includes yieldable portions 1842, 1844 that are formed only from portions of end flaps and end wall panels comprising end closure structure 1802*a*. Referring to FIG. 18, to form the end closure structure 1802*a*, end flap 1720*a* is folded along fold line 1722*a* into an upward vertical position. End flap 1732*a* is folded along fold line 1734*a* into a downward vertical position. End wall panels 1724*a* and 1728*a* are folded toward one another along respective fold lines 1726*a* and 1730*a* to close the carton 1800. In these positions, the end wall panels 1724*a* and 1728*a* are glued together in an overlapping relationship to traverse the end of the carton. Thus, end wall panels 1724*a* and 1728*a* almost completely overlap top and bottom end flaps 1732*a* and 1720*a*. However, end flap 1732*a* is notched at each side edge to prevent undesirably gluing the notched portions of top end flap 1732*a* to the End wall panels 1724*a* and 1728*a*, thereby automatically freeing the notched portions of top end flap 1732*a* that remain after the detachable portion 1750 has been removed. End wall panel 1724*a* is preferably secured to a portion of composite end flap 1720*a* by means of an adhesive. Similarly, end wall panel 1728*a* is also preferably secured to a portion of the end flap 1720*a*.

Separation means 1764 and 1766 extend from severance line 1840 and terminate at respective fold line 1726*a*, 1730*a* bordering the side wall 1806 or 1804 that is adjacent to each yieldable portion 1842, 1844. Separation means 1764 and 1766 thereby enable variable and reversible movement of yieldable portions 1842, 1844 along the hinged edge that joins the remaining section of respective end wall panel 1724*a*, 1728*a* to the adjacent side wall 1704, 1706.

According to an aspect of this embodiment, yieldable portions 1842, 1844 are preferably partially detachable and therefore made yieldable somewhat automatically. The consumer first removes fully detachable portion 1750 via severance line 1840. In the version of the embodiment that is shown in the Figures, the consumer may utilize tear initiation means 1748 to grasp and remove fully detachable portion 1750. At this point, the carton 1800 is open and the endmost article is exposed to the consumer. Upon grasping the endmost article, the consumer preferably pulls the article out of the opening thereby displacing the yieldable portions 1842, 1844 outwardly. When the consumer is removing articles from the carton 1800, the yieldable portions 1842, 1844 yield so as to enlarge the opening to allow release of the articles. However, once an article has been removed, the yieldable portions 1842, 1844 revert back into substantially the original position to retain the remaining articles in the carton 1800.

It will be appreciated that composite end flap 1720*a* of carton 1800 includes a notch 1770 that may be substantially semicircular, and which remains after the fully detachable portion 1750 has been removed to serve at least in part to provide an additional access point for a consumer to insert a thumb or finger to aid in grasping an article from the bottom of the carton 1800, and also serves restrain articles in carton 1800 in conjunction with yieldable portions 1842, 1844 and the lower portions 1846, 1848 of end wall panels 1724*a* and 1728*a* that remain after fully detachable portion 1750 has been removed. It should also be noted that upper end flap 1732*a* is notched on either distal corner to minimize the overlap and to prevent undesired adhesion of the upper end flap 1732*a* to yieldable portions 1742, 1744. Thus, when the consumer first removes an article from the newly opened carton 1800, a minimal amount of force is required to partially detach the yieldable portions 1742, 1744 due to the minimal overlap and to separation means 1764, 1766.

The separation means 1764 and 1766 are positioned at or near natural stress points that would occur on a similar carton having no separation means if a user were to attempt to remove an article through the opening formed by removal of fully detachable portion 1750. In preferred embodiments, the dimensions and positioning of yieldable portions 1742, 1744 are also related to the dimensions of the articles enclosed within the carton 1800. Each of yieldable portions 1742, 1744 has a height that is defined as the distance D2 from the respective separation means 1764, 1766 to the top wall 1808, as measured along fold lines 1726*a*, 1730*a*. The distance D2 is preferably less than or substantially equal to the diameter of one cylindrical article.

Figure 19:
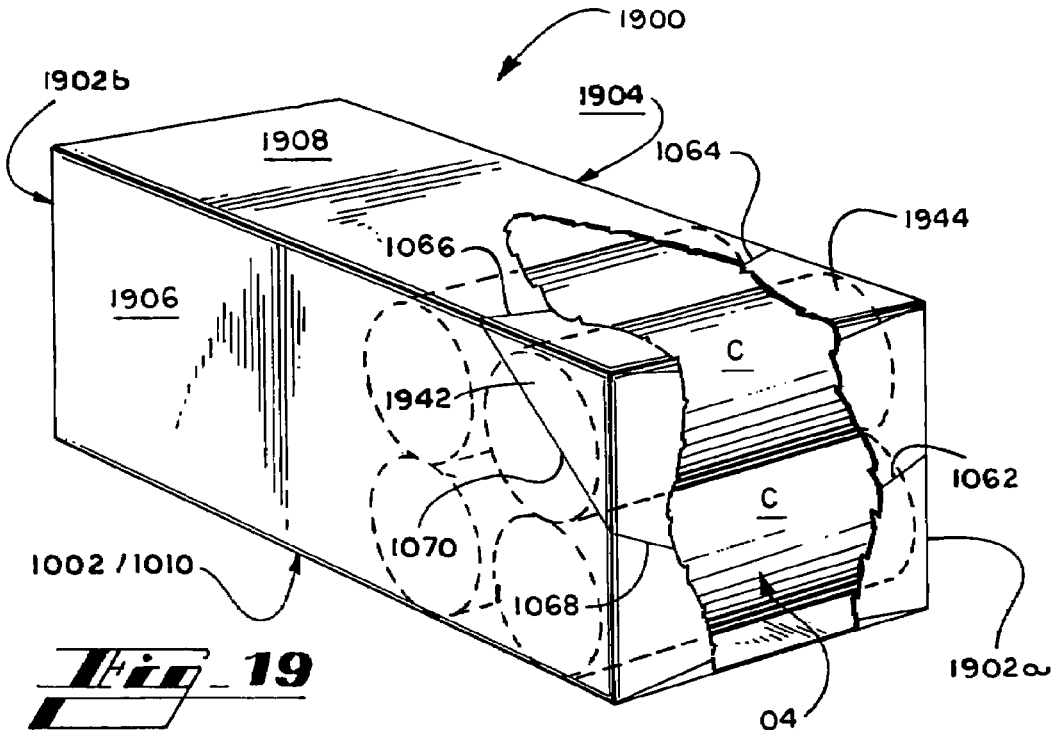
FIG. 19 is a perspective view of the carton of FIG. 12 with a fully detachable portion detached therefrom to define an opening for dispensing articles from the carton.
Figure 20:
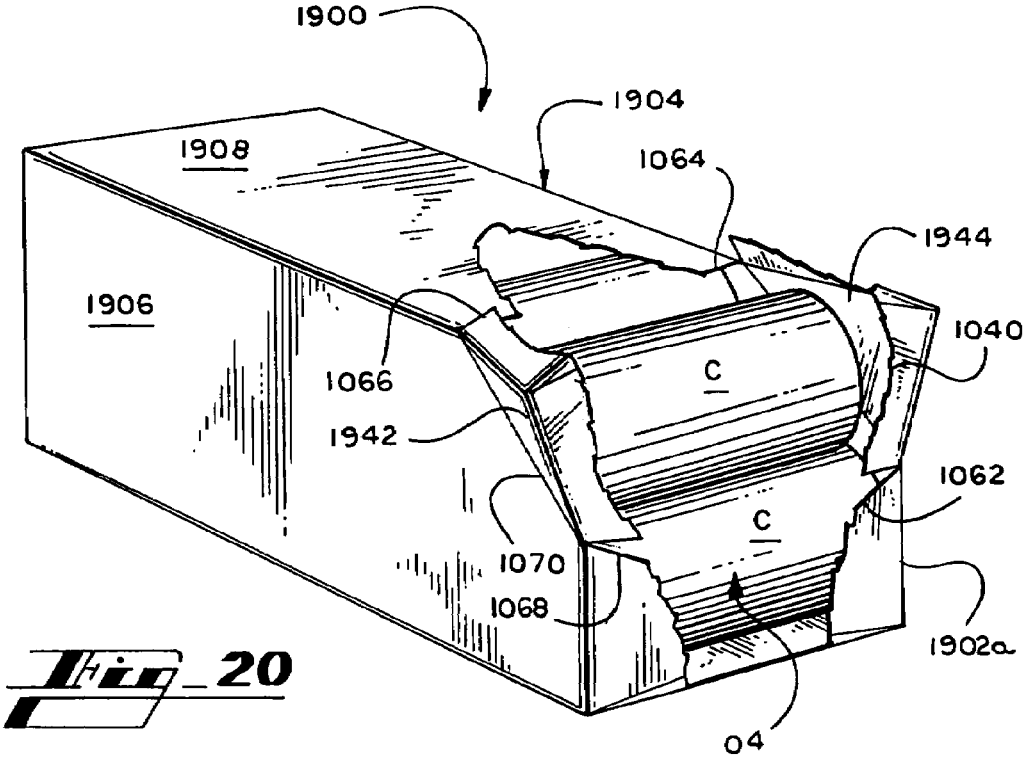
FIG. 20 is a perspective view of the carton of FIG. 12, opened by removing a fully detachable portion, and having yieldable portions partially detached to variably and reversibly enlarge the opening to facilitate dispensing articles from the carton.

Removal of first detachable portion 1750 from carton 1800 defines an opening for dispensing articles and defines an edge of yieldable portions 1842, 1844 for selectively retaining or facilitating dispensing of articles. Upon removing detachable portion 1050, the article C is prevented from accidentally rolling out of the carton 1900 through the opening by yieldable portion 1142 and by yieldable portion 1144, as shown in FIG. 19. The lower article C2 is restrained by the lower portion of the end closure structure 1102*a* that remains after the detachable portion 1050 has been removed. As shown in FIG. 20, an endmost article C may be removed through the opening defined by removal of detachable portion 1050 (not shown) as defined by continuous frangible line 1140, and reconfigured by repositioning yieldable portions 1142, 1144 so as to enlarge the opening.

Separation means 1062, 1064, 1066, 1068 are preferably extensively more weakened than the severance line 1140 to allow easier separation of the partially detachable portions 1142, 1144 from the adjacent walls. As shown in FIG. 20, the partially detachable portions 1142, 1144 may then be pivoted around the axis of the respective fold line 1072, 1070 to variably and reversibly enlarge the opening to facilitate removal of the endmost article from the carton. Thus, the partially detachable portions 1142, 1144, when pivoted back to the initial position shown in FIG. 18, can again restrain the remaining articles in the carton.

Figure 21:
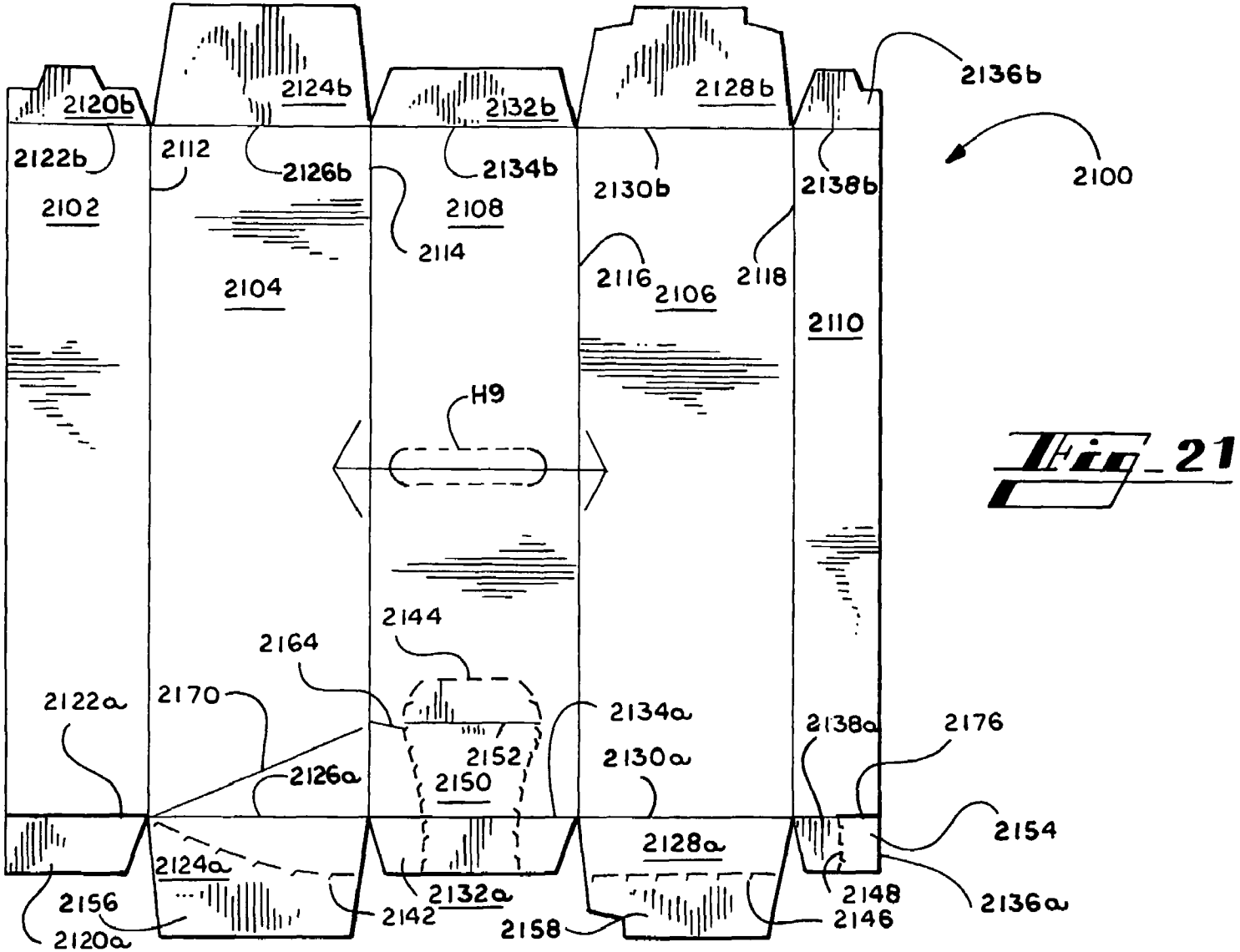
FIG. 21 is a plan view of one embodiment of a blank for forming a sixth alternative embodiment of a carton having a first detachable portion and at least one second detachable portion that is yieldable and partially detachable.
Figure 22:
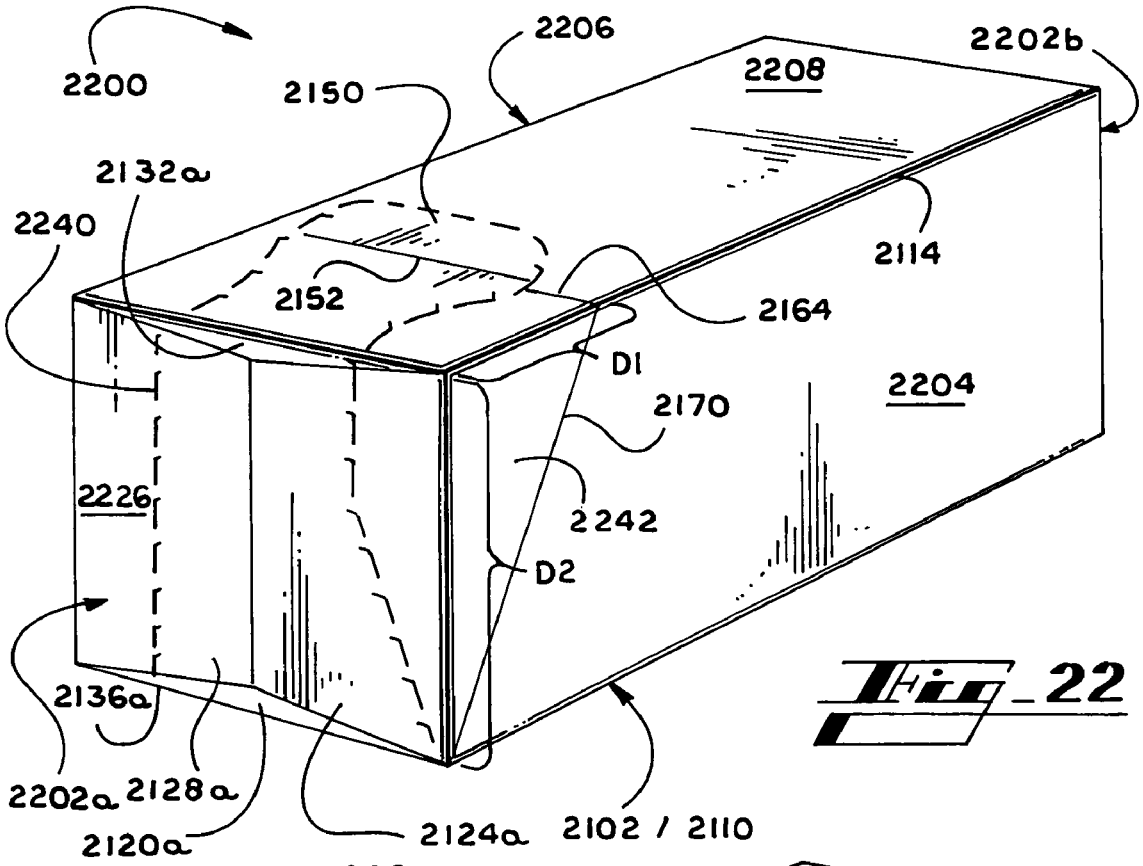
FIG. 22 is a perspective view of a carton of the present invention formed from the blank of FIG. 21.
Figure 23:
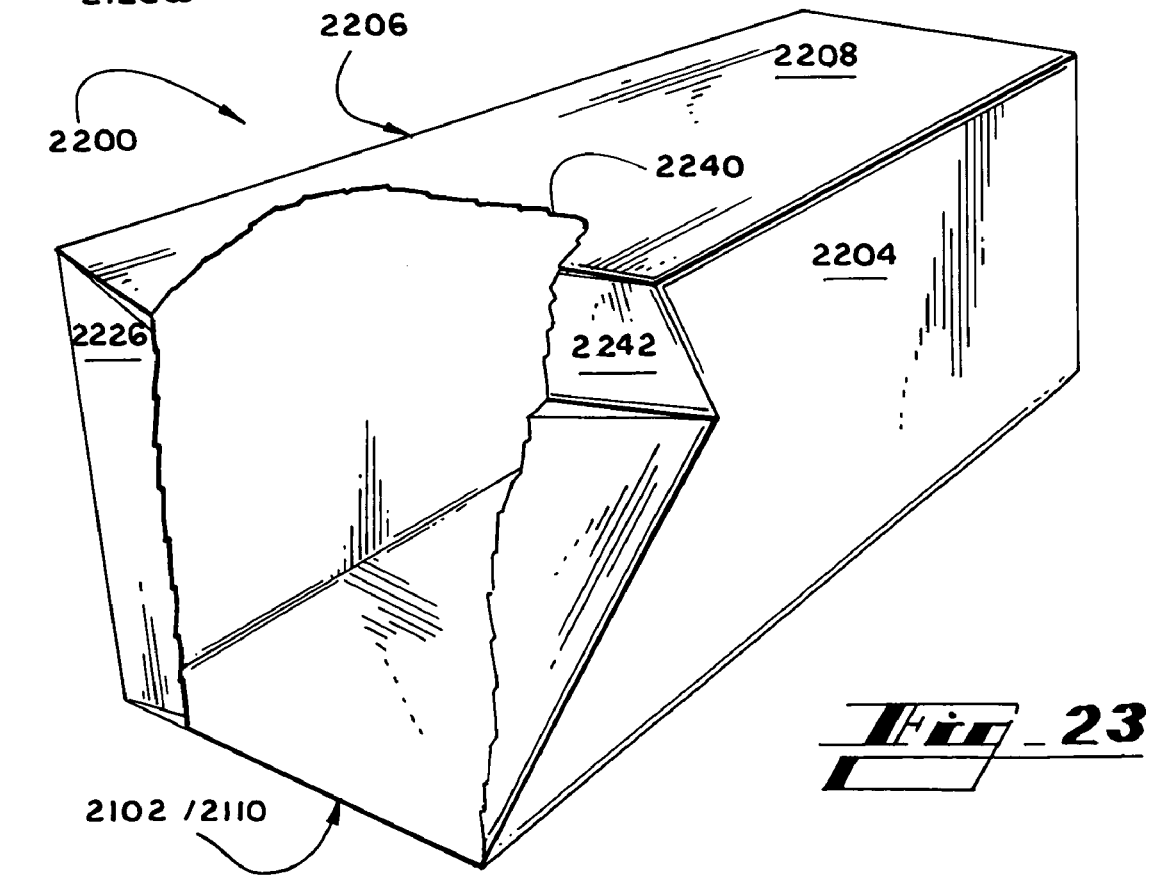
FIG. 23 is a perspective view of the carton of FIG. 22, opened by removing a detachable portion, and having a yieldable portion partially detached to variably and reversibly enlarge the opening to facilitate dispensing articles from the carton.

FIGS. 21 through 23 demonstrate that a first detachable portion advantageously can be combined with a single second detachable portion that is yieldable, and with a rigid retention means.

The blank 2100 includes frangible severance lines 2122*a*, 2142, 2144; 2146, 2148 and 2176 which when the carton is erected, form a continuous frangible severance line 2240 (shown in FIG. 22) that defines a detachable portion 2150. Fold line 2122*a* also functions as a severance line for removal of detachable portion 2150, and hence is also referred to as severance line 2122*a*. The severance line 2142 extends from the intersection of fold line 2126*a* and the proximal edge of end wall panel 2124*a*, and terminates on the side of end wall panel 2124*a* that is adjacent to end flap 2132*a*. One skilled in the art will recognize that the curvature, shape, and/or orientation of severance line 2142 is preferably determined in part to optimally retain articles in the carton 2200, and optionally, is designed to facilitate the linear application of the necessary adhesive at predefined intervals along the end flaps 2120*a*/2136*a*, 2132*a* and end wall panels 2124*a*, 2128*a* of the carton 2200, using the optimal number of adhesive applicators such as glue guns mounted on automatic packaging machinery. Any curvature, shape, or orientation of severance line 2142 that accomplishes one or both of these objectives can be used. Severance line 2144 extends from the distal edge of end flap 2132*a* across fold line 2134*a*, onto top wall 2108, and turns back to cross fold line 2134*a* again without crossing over itself, to terminate at another point on the distal edge of end flap 2132*a*. Portions of the severance line 2144 across end flap 2132*a* and adjacent fold line 2134*a* are preferably arched or curved somewhat inward relative to one another so that the portion 2144 is narrowest at the distal ends of end flap 2132*a*. Severance line 2146 extends transversely across end wall panel 2128*a*. Severance line 2148 extends longitudinally from the distal edge of end flap 2136*a* to the proximal edge of end flap 2136*a*, terminating at fold line 2138*a*. Severance line 2176 is preferably coincident with a portion of fold line 2138*a*.

In certain embodiments, to facilitate removal of a portion of end flap 2136*a* along with detachable portion 2150, and to discourage separation of the adhesive or other means used to secure end flap 2136*a* to end flap 2120*a*, severance line 2148 may be relatively weaker than the other severance lines and/or the adhesive may be relatively stronger than severance line 2148.

The blank 2100 further comprises a suitable known handle H to allow the user to carry the carton. Certain embodiments also include one or more horizontal score lines such as fold line 2152 to facilitate the initiation of a tear for detachment of detachable portion 2150.

In certain embodiments, the dimensions and positioning of the yieldable portion 2204 are also related to the dimensions of the articles enclosed within carton 2200. Yieldable portion 2242 has a depth, as defined as the distance D1 from the separation means 2164 to the end wall 2202*a*, measured along fold line 2114. The distance D1 is preferably less than or substantially equal to the diameter of one cylindrical article. Yieldable portion 2242 has a height that is defined as the distance D2, which is preferably equal to at least a portion of the total height of the carton 2200, and further, is preferably equal to the diameter of one cylindrical article multiplied by the number of rows of articles in the article group enclosed by the carton 2200.

As can be seen in FIG. 23, partial detachment of yieldable portion 2242 allows movement of thereof along fold line 2170 (shown in FIGS. 21 and 22) in the respective side wall 2204, thereby facilitating access to an end of an article for removal of that article. The yieldable portion 2242 of the retention means is defined by at least a portion of severance line 2142, separation means 2164, and fold line 2170, and a portion of severance line 2144. Rigid portion 2226 reinforces the carton 2200 and provides constant article retention by maintaining unyielding hinged connections with top wall 2208 and composite bottom wall 2102/2110.

According to an aspect of the invention, yieldable portion 2242 may be partially detachable and therefore made yieldable somewhat automatically. The consumer first removes detachable portion 2150 via continuous frangible line 2240. At this point, the carton 2200 is open and the endmost article is exposed to the consumer. Upon grasping the endmost article, the consumer preferably pushes the article toward the yieldable portion 2242, thereby displacing the yieldable portion 2242 outwardly via separation means 2208, and along fold line 2170. When the consumer is removing an article from the carton 2200, the yieldable portion 2242 thus yields so as to enlarge the opening to allow release of the articles. The rigid portion 2226 at the same time retains the next article in the carton while the first article is being removed. The fold line 2170 is preferably scored only as deeply as necessary to define the fold line, facilitate yielding of the yieldable portion 2242, and to preserve the resiliency and memory of the side wall 2204 such that the yieldable portion 2242 springs back into place before the next article has the opportunity to escape the rigid portion 2226 of the retention means. Thus, once an article has been removed, the yieldable portion 2204 reverts back into substantially the original position to retain the remaining articles in the carton 2200. Separation means 2164 is preferably extensively more weakened than the remainder of the continuous frangible line 2240 to allow easier separation of the partially detachable yieldable portion 2242 from the side wall 2204. As shown in FIG. 23, the partially detachable yieldable portion 2204 may then be pivoted around the axis of the fold line 2170.

Removal of detachable portion 2150, 2154, 2156, 2158 from carton 2200 defines an opening for dispensing articles. For example, as shown in FIG. 23, an endmost article on the uppermost row of the article group may be removed through the opening defined by removal of detachable portion 2150 as defined by continuous frangible line 2240. The article is prevented from accidentally rolling out of the carton through the opening by yieldable portion 2242 at one end of the article and by rigid portion 2226 at the opposite end of the article. An article on the lowermost row is restrained by the lower portion of the rigid portion 2226.

Each exemplary carton 200, 600, 800, 1100, 1400, 1600, 1800, 2200 described herein includes at least three adjacent carton walls. A detachable portion 142, 542, 742, 1050, 1250, 1350, 1550, 1750, 2150 defined by a severance line is formed at least from the first and second walls. The first wall may be an end wall or top wall. The second wall may be a top wall or side wall. The third wall may be a side, top or end wall. In certain embodiments, at least one separation means extends from the severance line to the third wall to facilitate yielding movement of a yieldable second detachable portion of the carton, adjacent to the removable portion. The yieldable portion is at least partially detachable and is defined at least in part by the at least one of separation means and in part by a fold line that is formed in or at an edge of the third wall. The separation means may be a severance line or a friction joint between two adjacent walls. In certain embodiments, the first detachable portion extends into a fourth wall that is opposite the second wall.

However, it should be understood that the orientation of the elements can be varied according to the needs of the consumer, particularly with respect to configuration of storage and refrigeration units. As an example, depending on the application, the first detachable portion of a carton may extend across a side and an end panel, and one or more yieldable portions may be hingedly connected to a top panel and an end panel. Furthermore, carton 2200 demonstrates that a single yieldable portion formed substantially on one side of a carton is effective to dispense and retain articles in the carton.

The present invention has been illustrated in relation to a particular embodiment that is intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A carton for encasing and dispensing articles, comprising:

a first wall;

a second wall adjacent to said first wall;

a third wall adjacent to said first wall and to said second wall;

a first detachable pottion detachably connected to said first and second walls, said first detachable portion being defined by a first frangible line extending at least partially across said first and second walls, said first detachable portion to be detached from said carton to define an opening; and a second detachable portion detachably connected to said first wall by said first frangible line, said second detachable portion being defined in part by removal of said first detachable portion and that includes at least part of two or more of said first wall, said second wall, and said third wall, said second detachable portion capable of:

being at least partially detached after said first detachable portion has been detached from said carton, so as to enlarge said opening to expose at least one endmost article for removal from said carton; and restraining articles in said carton after said first detachable portion has been detached from said carton.

2. The carton of claim 1, wherein said second detachable portion is further defined by separation means extending first from said frangible line to said third wall, said separation means facilitating at least partial detachment of said second detachable portion.

3. The carton of claim 2, wherein the distance between said separation means and an intersection between said first and second walls is less than or substantially equal to the diameter of one cylindrical article.

4. The carton of claim 1, wherein said second detachable portion is further defined by separation means extending from said first frangible line and at least partially across said third wall, said separation means facilitating at least partial detachment of said second detachable portion.

5. The carton of claim 4, wherein said second detachable portion is further defined by at least one fold line that extends at least partially across said third wall such that said second detachable portion is yieldable about said fold line and said opening is variably and reversibly enlargeable.

6. The carton of claim 1, further comprising a fourth wall opposed to said second wall and adjacent to said third wall, wherein:

said first frangible line extends at least partially across said fourth wall; and said first detachable portion is also detachably connected to said fourth wall.

7. The carton of claim 6, wherein said separation means is a second frangible line that defines an article stopper formed from a portion of said second, third, and fourth walls.

8. The carton of claim 1, further comprising:

a fourth wall opposed to said third wall; and a third detachable portion that is defined by removal of said first detachable portion and by separation means extending from said first frangible line to said fourth wall, said separation means facilitating at least partial detachment of said third detachable portion, said third detachable portion capable of:

being at least partially detached after said first detachable portion has been detached from said carton, so as to enlarge said opening to expose at least one endmost article for removal from said carton; and restraining articles in said carton after said first detachable portion has been detached from said carton.

9. The carton of claim 8, wherein the distance between said separation means and an intersection between said first and second walls is less than or substantially equal to the diameter of one cylindrical article.

10. The carton of claim 1, wherein:

said first wall is one of an end wall or a top wall;

said second wall is one of a side wall, a top wall, or an end wall; and said third wall is one of a side wall, a top wall, or an end wall.

11. The carton of claim 4, wherein said second detachable portion is to be completely detached after said first detachable portion is detached.

12. The carton of claim 1, further comprising:

a fourth wall opposed to said third wall; and a rigid means for retaining one end of endmost articles in said carton while said second detachable portion restrains an opposite end of endmost articles in said carton after said first detachable portion has been detached from said carton, said retention means being formed from a portion of said second wall and defined by removal of said first detachable portion.

13. The carton of claim 1, further comprising tear initiation means for initiating detachment of said first detachable portion.

14. A carton for encasing and dispensing articles, comprising:

a first wall;

a second wall adjacent to said first and second walls;

a third wall adjacent to said first and second walls;

a first detachable portion detachably connected to said first and second walls, said first detachable portion being defined by a frangible line extending at least partially across said first and second walls, said first detachable portion to be detached from said carton to define an opening; and a second detachable portion detachably connected to said first wall by said frangible line, said second detachable portion being defined in part by removal of said first detachable portion, said second detachable portion capable of:

being at least partially detached after said first detachable portion has been detached from said carton, so as to enlarge said opening to expose at least one endmost article for removal from said carton; and restraining articles in said carton after said first detachable portion has been detached from said carton;

wherein said second detachable portion is further defined by:

at least one fold line that extends at least partially across said third wall such that said second detachable portion is yieldable about said at least one fold line and said opening is variably and reversibly enlargeable; and separation means extending from said frangible line to said third wall, said separation means facilitating at least partial detachment of said second detachable portion.

15. A carton for encasing and dispensing articles, comprising:

a second wall adjacent to said first wall;

a third wall adjacent to said first and second walls;

a fourth wall opposed to said third wall;

a first detachable portion detachably connected to said first and second walls, said first detachable portion being defined by a frangible line extending at least partially across said first and second walls, said first detachable portion to be detached from said carton to define an opening; and a second detachable portion and a third detachable portion that are each defined in part by removal of said first detachable portion, each of said second detachable portion and said third detachable portion detachably connected to said first wall by said frangible line, each of said second detachable portion and said third detachable portion capable of:

being at least partially detached after said first detachable portion has been detached from said carton, so as to enlarge said opening to expose at least one endmost article for removal from said carton; and restraining articles in said carton after said first detachable portion has been detached from said carton;

wherein said third detachable portion is further defined by a fold line that extends at least partially across said fourth wall such that said third detachable portion is yieldable about said fold line and said opening is variably and reversibly enlargeable.

16. A carton for encasing and dispensing articles, comprising:

a first wall;

a second wall adjacent to said first wall;

a third wall adjacent to said first and second walls;

a fourth wall opposed to said second wall and adjacent to said third wall;

a first detachable portion detachably connected to said first wall, said second wall, and said fourth wall, said first detachable portion being defined by a first frangible line extending at least partially across said first wall, said second wall, and said fourth wall, said first detachable portion to be detached from said carton to define an opening; and a second detachable portion detachably connected to the first wall by said first frangible line, said second detachable portion being defined in part by removal of said first detachable portion, said second detachable portion capable of:

being at least partially detached after said first detachable portion has been detached from said carton, so as to enlarge said opening to expose at least one endmost article for removal from said carton; and restraining articles in said carton after said first detachable portion has been detached from said carton;

wherein said second detachable portion is further defined by separation means extending from said first frangible line to said third wall, said separation means facilitating at least partial detachment of said second detachable portion, said carton further comprising a fourth wall opposed to said second wall and adjacent to said third wall, wherein said first frangible line extends at least partially across said fourth wall and said first detachable portion is also detachably connected to said fourth wall, wherein said separation means is a second frangible line that defines an article stopper formed from a portion of said second, third and fourth walls;

wherein the height of said article stopper at an intersection between the second and third walls is greater than the height of said article stopper at the intersection between the third and fourth walls.

17. A carton for carrying articles, said carton comprising:

a plurality of walls, comprising:

a top wall; and an end wall adjacent to said top wall, said end wall comprising end flaps and end wall panels of said carton;

a detachable portion detachably connected to said top wall and said end wall, said detachable portion being defined by a frangible line integral to said top wall and said end wall, said detachable portion to be detached from said carton to define an opening for exposing at least one endmost article for removal from said carton; and a retention means for restraining the at least one endmost article after said detachable portion has been detached from said carton, comprising:

at least one yieldable portion detachably connected to said top wall by said frangible line, said at least one yieldable portion for restraining at least one end of the at least one endmost article, wherein upon partially detaching said at least one yieldable portion, said at least one yieldable portion is hingedly connected to said carton via a fold line so as to variably and reversibly enlarge said opening to facilitate removal of the at least one endmost article from said carton; and separation means for partially detaching said at least one yieldable portion, said separation means originating from said frangible line and terminating substantially near an end of said fold line;

wherein said at least one yieldable portion is:

adjacent to said detachable portion along at least a portion of said frangible line;

detachably connected to at least one of said top wall and said end wall; and hingedly connected to a side wall that is adjacent to said end wall and to said top wall.

18. The carton of claim 17, wherein said retention means further comprises a rigid portion for restraining an end opposite the at least one end of the at least one endmost article, said rigid portion being opposite said at least one yieldable portion and adjacent to said detachable portion along at least a portion of said frangible line.

19. A package, comprising:

an article group formed of at least one row of cylindrical articles, said at least one row including a plurality of said articles disposed on sides thereof in a side-by-side parallel fashion; and a carton disposed around said group, said carton comprising:

top and bottom opposed walls interconnected by a pair of opposed side walls to form a tubular structure, wherein each of said side walls is disposed alongside adjacent ends of said articles of said group;

an end closure structure at least partially closing an end of said tubular structure, wherein said end closure structure is disposed alongside a side of an endmost one of the articles in each said at least one row; and an article dispenser for dispensing at least said endmost one of the articles in each said at least one row from said carton, wherein said article dispenser comprises:

a detachable portion formed at least in part from said top wall and from said end closure structure, said detachable portion being detachably connected to said top wall and said end closure structure by a frangible line, and said detachable portion to be detached from said carton to define an opening for exposing said endmost article for removal; and a retention means for retaining said endmost one of the articles in said carton after said detachable portion has been detached from said carton, said retention means comprising:

a yieldable portion detachably connected to said top wall by said frangible line, said yieldable portion for restraining at least one end of said endmost one of the articles, said yieldable portion being formed at least in part from said end closure structure and from one of said side walls, and said yieldable portion being defined in part by said frangible line;

wherein upon partially detaching said yieldable portion, said yieldable portion is hingedly connected to said carton via a fold line extending across at least a portion of one of said side walls so as to variably and reversibly enlarge said opening to facilitate removal of said at least one endmost article from said carton.

20. The package of claim 19, wherein said retention means further comprises a rigid portion for restraining an opposite end of said endmost one of the articles, said rigid portion being defined in part by said frangible line.

21. A carton for retaining and dispensing articles in an article group enclosed by said carton, comprising:

a first wall;

a second wall adjacent to said first wall;

a third wall adiacent to said first wall and to said second wall;

a dispenser for dispensing at least one endmost article, said dispenser comprising:

a detachable portion that, when detached from said carton, defines an opening for exposing said at least one endmost article for removal from said carton, said detachable portion being detachably connected to at least said first wall and said second wall; and at least one yieldable portion detachably connected to said first wall by a frangible line, said at least one yieldable portion being defined in part by detachment of said detachable portion and by a hinged connection to said third wall by a fold line, said at least one yieldable portion being for facilitating removal of said endmost article from said carton, said at least one yieldable portion being yieldable along said fold line to variably enlarge said opening;

wherein said at least one yieldable portion includes at least part of two or more of said first wall, said second wall, and said third wall.

22. The carton of claim 21, wherein said at least one yieldable portion is further for restraining at least one end of the at least one endmost article after said at least one detachable portion has been detached from said carton by yielding along said fold line so as to variably reduce said opening in order to facilitate restraining articles in said carton after said at least one detachable portion has been detached from said carton.

23. The carton of claim 21, wherein said dispenser further comprises a rigid portion for restraining an opposite end of the at least one endmost article.

24. A blank for forming a carton for encasing and dispensing articles, said blank comprising:

a first panel for forming a first wall of the carton;

a second panel hingedly connected to said first panel, said second panel being for forming a second wall of the carton;

a third panel hingedly connected to said first and second panels, said third panel being for forming a third wall of the carton;

a first detachable portion detachably connected to said first and second panels, said first detachable portion being defined by a frangible line extending at least partially across said first and second panels, said first detachable portion to be detached from the carton to define an opening; and a second detachable portion detachably connected to said first wall by said frangible line, said second detachable portion being adjacent to said first detachable portion, said second detachable portion being defined by at least one separation means extending from said frangible line to said third panel, and by at least one fold line extending at least partially across said third panel.

25. The blank of claim 24, wherein said second detachable portion is for:

being at least partially detached after said first detachable portion has been detached from the carton, so as to enlarge said opening to expose at least one endmost article for removal from the carton; and restraining articles in the carton after said first detachable portion has been detached from the carton.

* * * * *